US011058182B2

(12) United States Patent
Hull

(10) Patent No.: US 11,058,182 B2
(45) Date of Patent: Jul. 13, 2021

(54) FOOTWEAR WITH REACTIVE LAYERS

(71) Applicant: NIKE, Inc., Beaverton, OR (US)

(72) Inventor: N. Scot Hull, Rye, NH (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/421,974

(22) Filed: May 24, 2019

(65) Prior Publication Data

US 2019/0313743 A1 Oct. 17, 2019

Related U.S. Application Data

(62) Division of application No. 13/774,186, filed on Feb. 22, 2013, now abandoned.

(51) Int. Cl.

| | |
|---|---|
| ***A43C 11/00*** | (2006.01) |
| ***A43B 23/02*** | (2006.01) |
| ***A43C 11/14*** | (2006.01) |
| ***A43C 1/00*** | (2006.01) |

(52) U.S. Cl.

CPC ..... *A43C 11/008* (2013.01); *A43B 23/027* (2013.01); *A43B 23/0265* (2013.01); *A43B 23/0295* (2013.01); *A43C 1/003* (2013.01); *A43C 11/14* (2013.01); *A43C 11/1493* (2013.01)

(58) Field of Classification Search

CPC ..... A43B 23/0265; A43B 23/027; A43B 23/0295

See application file for complete search history.

(56) References Cited

U.S. PATENT DOCUMENTS

| | | | | |
|---|---|---|---|---|
| 2002/0078591 | A1* | 6/2002 | Morrone | A43B 13/16 36/8.3 |
| 2011/0041362 | A1* | 2/2011 | Nishiwaki | A43B 23/045 36/114 |
| 2011/0302810 | A1* | 12/2011 | Borel | A43B 23/027 36/114 |
| 2012/0079742 | A1* | 4/2012 | Ferreira | A43C 11/002 36/54 |
| 2012/0129416 | A1* | 5/2012 | Anand | A43B 23/045 442/306 |
| 2014/0059734 | A1* | 3/2014 | Toronjo | A41D 1/00 2/69 |

FOREIGN PATENT DOCUMENTS

| | | | |
|---|---|---|---|
| DE | 3336442 | A1 | 4/1984 |
| DE | 4018518 | A1 | 1/1991 |
| GB | 494731 | A | 10/1938 |

* cited by examiner

*Primary Examiner* — Ted Kavanaugh
(74) *Attorney, Agent, or Firm* — Quinn IP Law

(57) ABSTRACT

An article of footwear includes an upper defining an opening for receiving a foot of a wearer and a sole structure affixed to an under side of the upper. The upper has a throat opening provided between a medial side of the upper and a lateral side, and further includes a forward portion for receiving a forefoot of the foot, a rearward portion for receiving a heel of the foot, and an intermediate portion between the forward portion and the rearward portion. The intermediate portion comprises a reactive material extending between the sole structure and the throat opening on both the medial side and on the lateral side of the upper. The reactive material has a negative Poisson's ratio and is bounded on either side by materials that have a positive Poisson's ratio.

10 Claims, 20 Drawing Sheets

FOOTWEAR WITH REACTIVE LAYERS

CROSS REFERENCE TO RELATED APPLICATIONS

The present application is a divisional of U.S. patent application Ser. No. 13/774,186, filed on 22 Feb. 2013, and published as US 2014/0237850, which is hereby incorporated by reference in its entirety.

BACKGROUND

The present embodiments relate generally to an article of footwear, and in particular to restraining elements in articles of footwear intended for use during athletic activities such as running, walking, skating, skiing, bicycling or jumping, and/or during games or sports such as basketball, soccer, volleyball, baseball, football, tennis, field hockey, ice hockey and other games or sports.

Articles of footwear typically have at least two major components, an upper that provides the enclosure for receiving the wearer's foot, and a sole secured to the upper that is the primary contact to the ground or playing surface. The footwear may also use some type of fastening system, for example, laces or straps or a combination of both, to secure the footwear around the wearer's foot. When the footwear is unfastened, the fastening system allows the person wearing the footwear to easily insert his/her foot into the footwear. When the fastening system is fastened, it securely holds the footwear to the foot, and provides stability and support appropriate for the intended activity or sport, while allowing sufficient flexibility.

SUMMARY

As used herein, the term "reactive material" shall mean a material that, when it is placed under tension in a first direction, it increases its dimensions in one or both of the directions orthogonal to the first direction. For example, if the material is in the form of a strap having a length, a width and a thickness, then when the strap is under tension longitudinally (i.e., lengthwise), it increases in width and/or in thickness. Reactive materials may be characterized as having a negative Poisson's ratio. In contrast, conventional materials tend to contract in width and thickness as their length expands. Examples of materials having these reactive properties are auxetic materials.

In one aspect, the article of footwear includes an upper, a sole, and a strap attached at one end to the medial side of the footwear, either at the side of the upper or at the sole, and attached at the other end to the lateral side of the footwear, either at the side of the upper or at the sole. The strap includes a layer made of reactive material. This layer will be referred herein as a "reactive layer." The reactive layer is constrained from expanding outwards. When the person wearing the footwear engages in an activity, such as leaping or accelerating, that puts the strap under increased longitudinal tension, the reactive layer increases its thickness and/or width and thus more firmly holds the footwear onto the foot.

In another aspect, the article of footwear includes an upper, a sole and a strap made of reactive material. The strap is attached at its medial and lateral ends to the medial and lateral sides, respectively, of the upper, or is attached to the medial and lateral sides, respectively, of the sole. The strap is routed, either partially or entirely within the footwear, such that when the strap is under longitudinal tension, the fabric of the upper constrains the strap so that when it expands in thickness it presses more firmly against the wearer's foot.

In another aspect, the article of footwear includes an upper, a sole and a composite strap attached at one end to the medial side of the footwear and at the other end to the lateral side of the footwear. The composite strap has at least two layers, one layer made of inelastic material and one layer made of a reactive material, i.e., a material that has a negative Poisson's ratio. The inelastic layer functions to prevent the layer made of reactive material from expanding outwards, so that when the strap is under longitudinal tension, it expands in thickness and/or width to hold the footwear more firmly onto the foot.

In another aspect, the article of footwear comprises a composite strap having an inner layer made from reactive material and an outer layer made from inelastic material. When the composite strap is under longitudinal tension, the reactive material increases in its thickness and/or its width, to hold the footwear more firmly on the wearer's foot.

In another aspect, an article of footwear includes an upper having a medial side and a lateral side. The upper further includes a forward portion associated with a forefoot portion of the upper, a rearward portion associated with a heel portion of the upper and an intermediate portion disposed between the forward portion and the rearward portion. The intermediate portion comprises a reactive material that increases in at least one of thickness and width when the intermediate portion is under longitudinal tension.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

For clarity, the detailed descriptions herein describe certain exemplary embodiments, but the disclosure herein may be applied to any article of footwear comprising certain of the features described herein and recited in the claims. In particular, although the following detailed description discusses exemplary embodiments, in the form of footwear such as running shoes, basketball shoes, sandals and flippers, the disclosures herein may be applied to a wide range of footwear.

For consistency and convenience, directional adjectives are employed throughout this detailed description corresponding to the illustrated embodiments. The term "longitudinal" as used throughout this detailed description and in the claims refers to a direction extending a length (or longest dimension) of a component, such as a strap. Also, the term "lateral" as used throughout this detailed description and in the claims refers to a direction extending along a width of a component, such as a strap. The lateral direction may generally be perpendicular to the longitudinal direction. Furthermore, the term "vertical" as used throughout this detailed description and in the claims refers to a direction generally perpendicular to a lateral and longitudinal direction. The vertical direction may be associated with the thickness or depth of a component, such as a strap.

Figure 1:
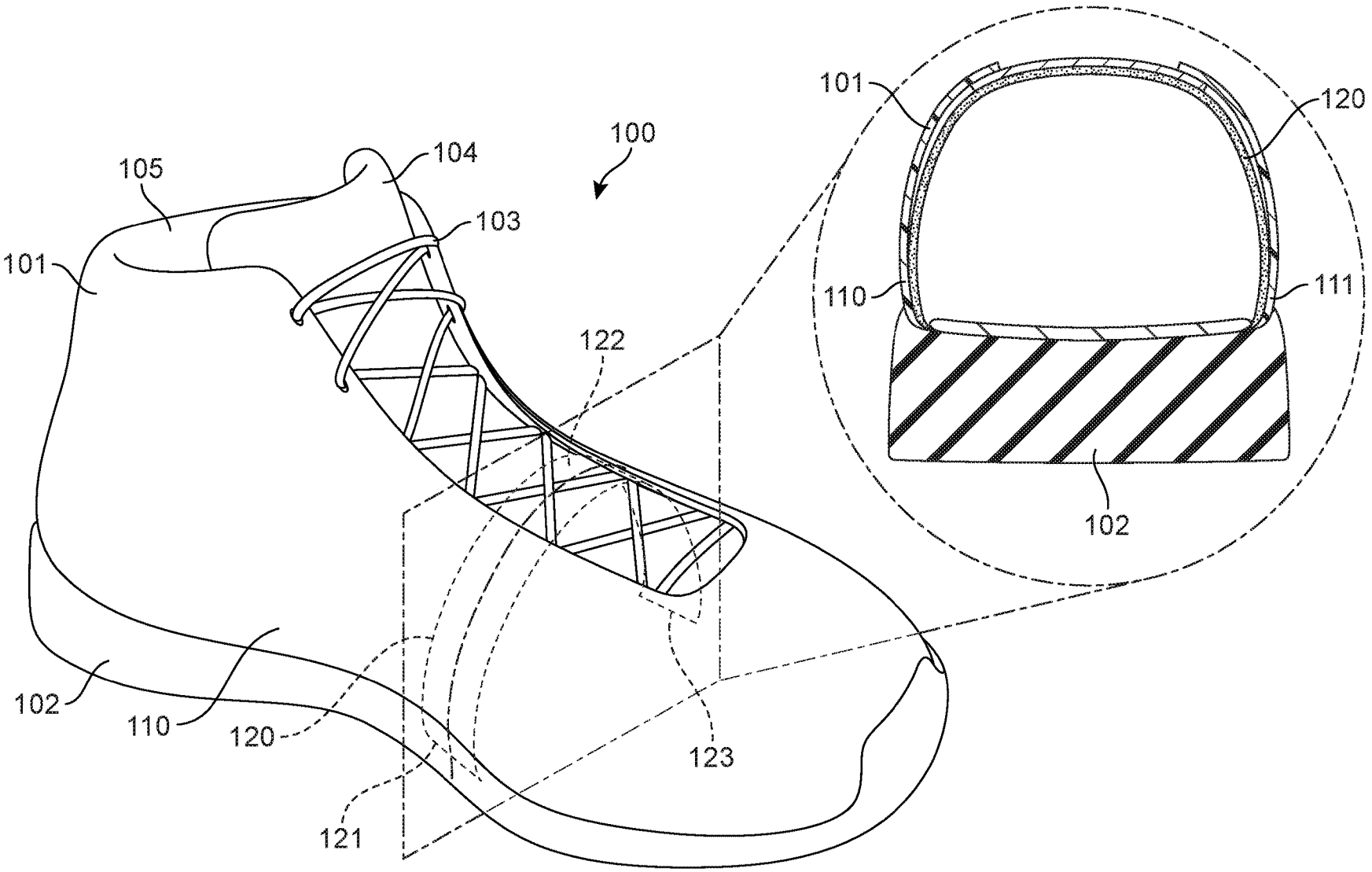
FIG. 1 is an isometric view of an embodiment of an article of footwear with an example of a unitary reactive strap.

FIG. 1 is an isometric view of an embodiment of an article of footwear 100. Article of footwear 100 may include upper 101 and sole 102. In some embodiments, upper 101 may further include tongue 104. Upper 101 may include an opening or throat 105 that allows the wearer to insert his or her foot into the footwear. In some embodiments, upper 101 may also include laces 103, which can be used to tighten or otherwise adjust the size of throat 105 around a foot.

Article of footwear 100 can include provisions for adaptively tightening to a user's foot. For example, some embodiments may incorporate components that tighten in response to activities such as jumping, running or cutting, thereby minimizing slip between a user's foot and article of footwear 100 during such activities. In some embodiments, article of footwear 100 may include one or more straps comprising reactive materials. As previously discussed, such materials may expand along dimensions perpendicular to the tensioning direction (e.g., expand in width and thickness while undergoing lengthwise tensioning).

As used throughout this detailed description and in the claims, the term "strap" refers to any generally two-dimensional member with a thickness much less than the length and/or width. In some cases, a strap may have an elongated shape, including for example, a rectangular area. However, the term strap is not intended to be limited to a particular shape and could include any member having any shape. For example, in some embodiments, a strap could extend through a large portion of an upper. In some embodiments, a strap may comprise a substantial entirety of the upper.

In some embodiments, article of footwear 100 may include reactive strap 120. In some embodiments, reactive strap 120 may be disposed internally to upper 101. More specifically, in some embodiments, a first end 121 of reactive strap 120 may be attached to the bottom of the interior of the medial side 110 of footwear 100, an intermediate portion 122 of reactive strap 120 may be routed over the arch of the wearer's foot, below tongue 104, and a second end 123 of reactive strap 120 may be attached to the lateral side 111 of article of footwear 100. In other embodiments, the arrangement of reactive strap 120 along article of footwear 100 could vary in any manner. Other possible arrangements or configurations are described in further detail below.

Reactive strap 120 can be attached at the bottom of the interior lateral and medial sides of upper 101 using stitching, stapling, fusion, adhesives or any other type of permanent attachment method. It can alternatively be attached to the top surface of the sole on both sides of the footwear, instead of to the interior sides of the footwear. Reactive strap 120 is shown in phantom in FIG. 1, because reactive strap 120 is wholly within the footwear.

The current embodiment describes a generally unitary reactive strap 120. In other words, reactive strap 120 may comprise a single layer. However, in other embodiments, a strap including a reactive material could incorporate two or more layers or portions having distinct material properties. An example of a composite strap including a reactive layer and an additional layer with different material properties from the reactive layer is described in further detail below.

In different embodiments, reactive strap 120 may be made from various materials. In some embodiments, reactive strap 120 may be made from any materials having a negative Poisson's ratio, including, for example, auxetic materials. Such materials are available, for example, from Advanced Fabric Technologies, Houston, Tex. and from Auxetic Technologies Ltd., Bolton, UK.

The call-out in FIG. 1 shows a cross-section of footwear 100. In particular, the call-out in FIG. 1 shows how unitary reactive strap 120 fits within the fabric of upper 101. When strap 120 is under tension, its thickness and width increase, as discussed below with reference to FIGS. 2-4. Because strap 120 is constrained by the fabric of upper 101 from expanding outwards, any increase in thickness of strap 120 would force strap 120 to press more firmly against the foot and thus serves to hold the footwear more securely on the foot.

Although FIG. 1 shows a generic shoe, other embodiments of the footwear could include, for example, running shoes, walking shoes, basketball shoes, tennis shoes, soccer shoes, baseball shoes, skates or boots, all of which need to secure the footwear to the foot so as to maximize comfort and performance.

Figure 4:
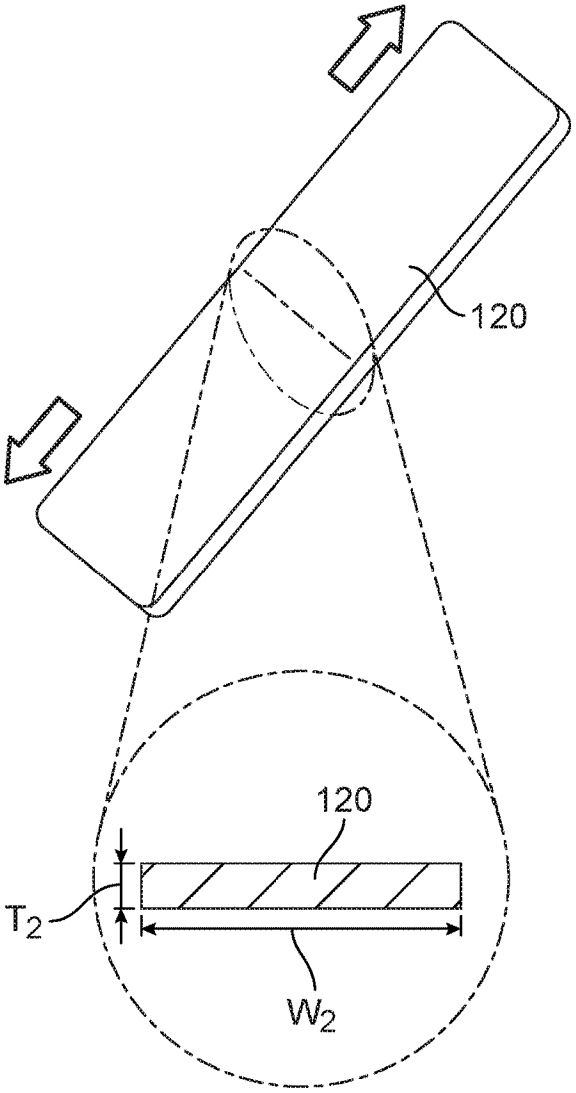
FIG. 4 is an isometric view of an embodiment of a unitary strap under increased longitudinal tension.
Figure 3:
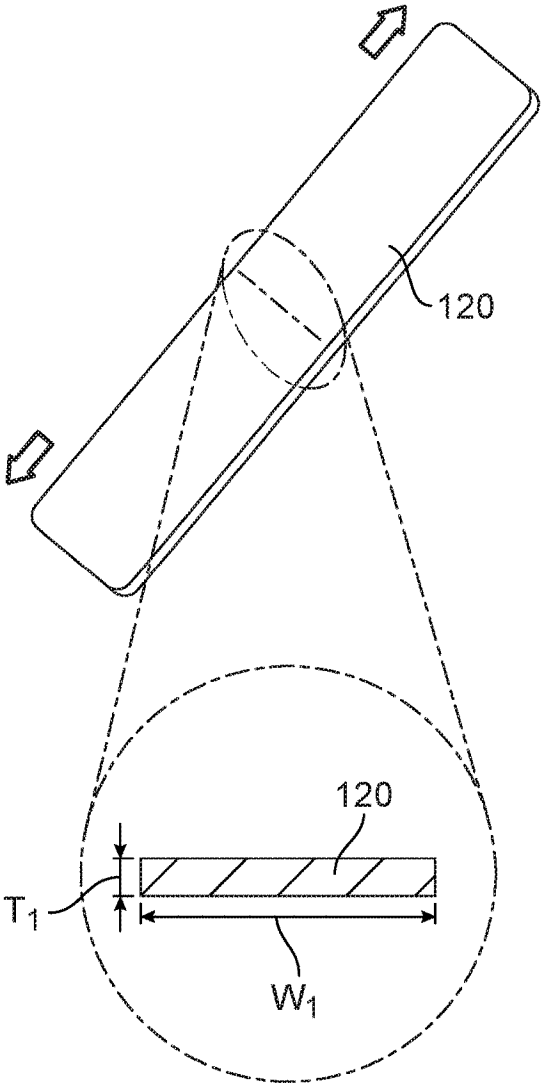
FIG. 3 is an isometric view of an embodiment of a unitary strap under longitudinal tension.
Figure 2:
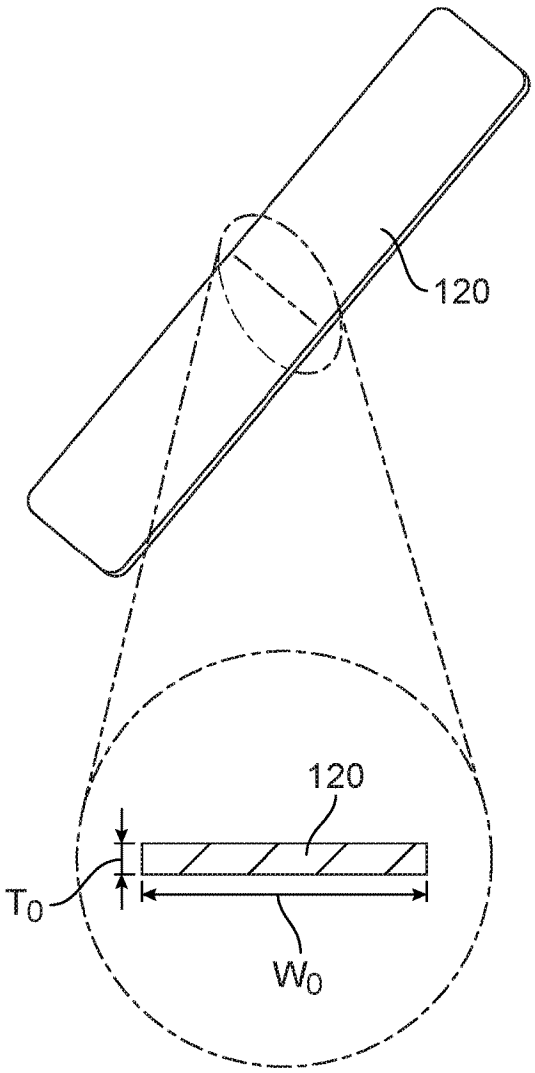
FIG. 2 is an isometric view of an embodiment of a unitary strap when it is not subject to any longitudinal tension.

FIGS. 2-4 show how reactive strap 120 behaves under longitudinal tension. In FIG. 2, strap 120 is not under tension, and it has a thickness $T_0$ and a width $W_0$. In FIG. 3, strap 120 is under tension. Because it is under tension, its thickness has increased to $T_1$ (which is greater than $T_0$) and its width has increased to $W_1$ (which is greater than $W_0$). In FIG. 4, strap 120 is under increased tension, and its thickness is now $T_2$ (which is greater than $T_1$) and its width is now $W_2$ (which is greater than $W_1$). Thus, as seen in FIGS. 2-4, reactive strap 120 may tend to expand in thickness and width as reactive strap 120 is pulled longitudinally. This is in contrast to various other straps that may generally contract in width and thickness under longitudinal tension (e.g., under stretching).

In some cases, there may be a linear relationship between the increase in thickness and/or width of strap 120 and an increase in length of strap 120 under longitudinal tension. In the general case, however, there need not be such a relationship. In other embodiments, for example, there could be a nonlinear relationship between the increase in thickness and/or width of strap 120 and the increase in length of strap 120 under longitudinal tension.

Figure 5:
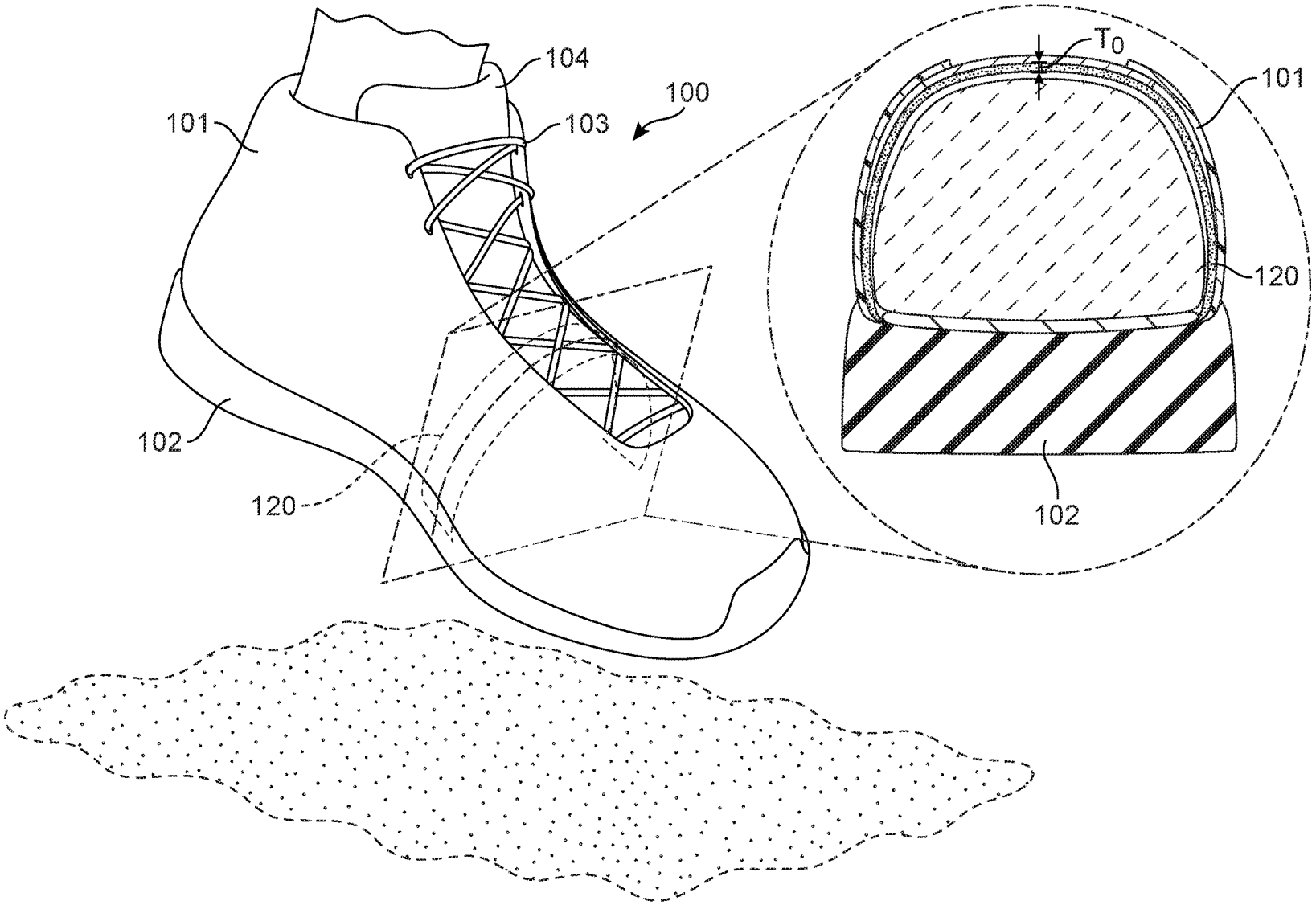
FIG. 5 is an isometric view of the embodiment of an article of footwear of FIG. 1 above a playing surface using an example of a unitary strap.
Figure 6:
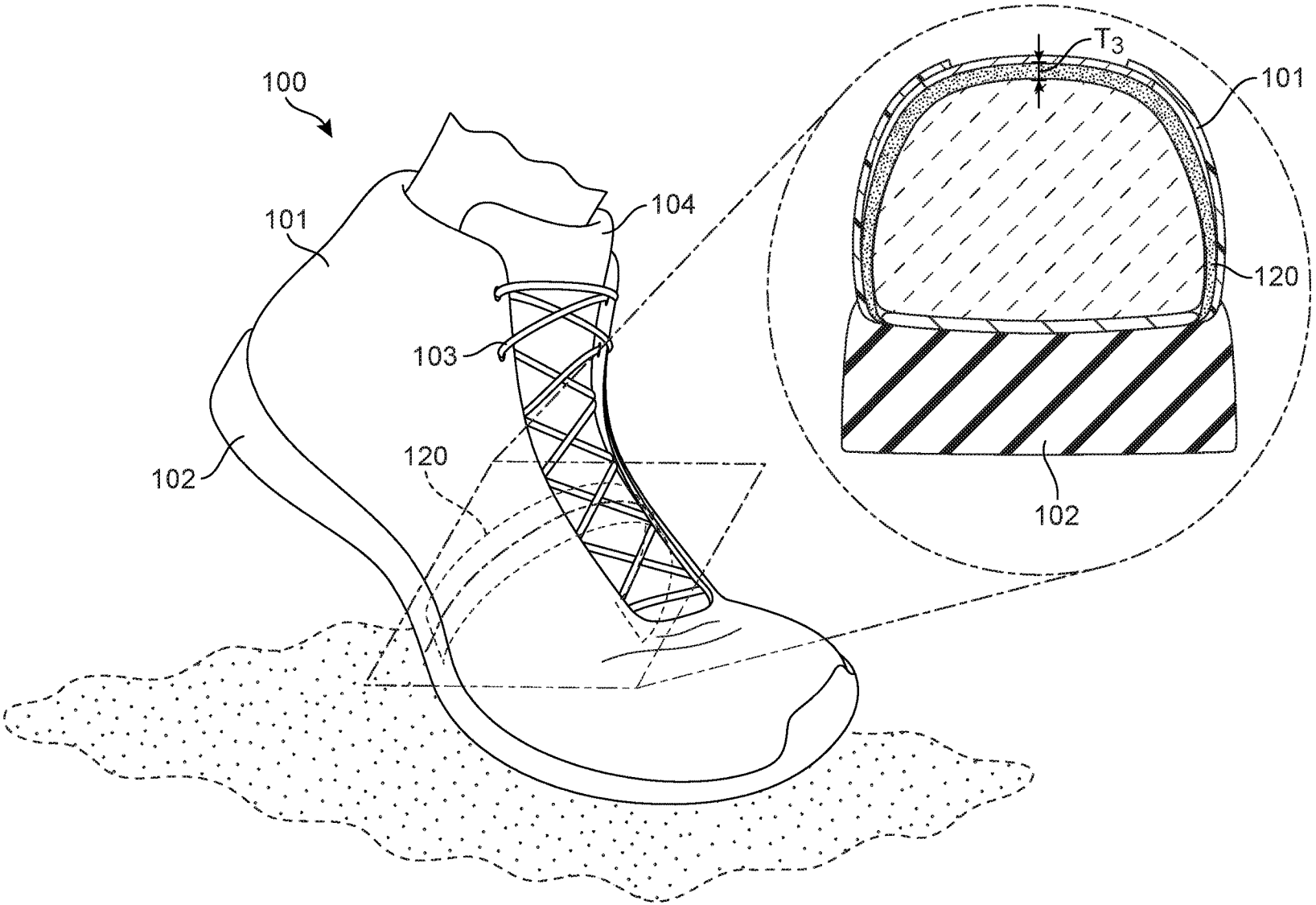
FIG. 6 is an isometric view of the embodiment of an article of footwear of FIG. 1 in contact with a playing surface using an example of a unitary strap.

FIGS. 5 and 6 show the embodiment of FIG. 1 in action. In FIG. 5, footwear 100 is not in contact with the playing surface. Reactive strap 120 only experiences minimal longitudinal tension. For that reason, the thickness and width of reactive strap 120 is not significantly greater than the thickness $T_0$ and width $W_0$, respectively, of reactive strap 120 when it is not under any tension. In FIG. 6, footwear 100 is in contact with the playing surface. Reactive strap 120 is under tension, for example because the wearer is pushing off his or her forefoot to leap or accelerate. Because it is under tension, the thickness and width of reactive strap 120 have increased. For example, the thickness of reactive strap 120 has increased to $T_3$ (which is substantially greater than $T_0$). Moreover, as the thickness of reactive strap 120 increases, reactive strap 120 may provide an increased radially inward force on the foot, thereby preventing in-shoe slip and enhancing support for the wearer.

The embodiment shown in FIGS. 1-6 illustrates an article of footwear including a reactive strap that is disposed internally to the upper. In particular, the entirety of the strap is disposed inwardly of the outer sidewalls of the upper as well as beneath the tongue. In other embodiments, however, some portions of a reactive strap could extend outwardly of the upper and/or tongue. In still other embodiments, the entirety of a reactive strap could extend outwardly of the upper and/or tongue.

Figure 7:
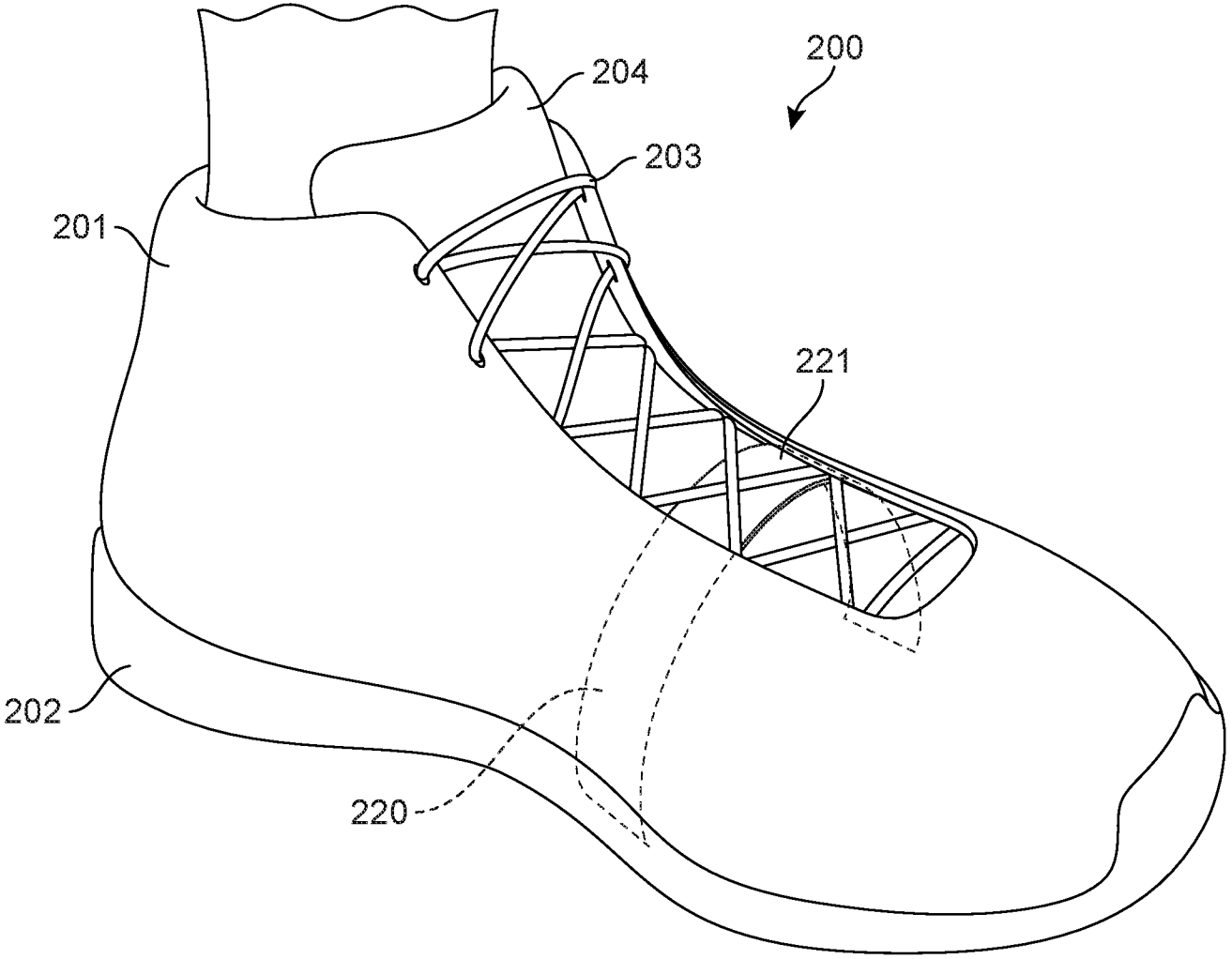
FIG. 7 is an isometric view of another embodiment of an article of footwear using an example of a unitary strap.

FIG. 7 is an isometric view of an example of another embodiment of an article of footwear. In this embodiment, article of footwear 200 may be similar to article of footwear 100 discussed above. In particular, article of footwear 200 may include upper 201, sole 202 as well as laces 203 and tongue 204. In this embodiment, reactive strap 220 is routed within footwear 200 above tongue 204 and below laces 203. In particular, reactive strap 220 may be permanently attached to the interior of article of footwear 200 footwear at both the lateral side and the medial side, for example by stitching, stapling, fusing or adhesives. While the end portions of reactive strap 220 may be disposed internally within upper 201, an intermediate portion 221 of reactive strap 220 may be exposed along an exterior of article of footwear 100. Reactive strap 220 can be attached either to the medial and lateral interior sides of the upper, respectively, or to the medial and lateral sides of the sole, respectively.

When reactive strap 220 is under tension, for example because the wearer is jumping, its thickness and width increase, thus tightening the footwear around the foot and providing improved stability. In this embodiment, reactive strap 220 functions to press tongue 204 down against the top of the wearer's foot, thus spreading the stress over a larger area. Such an embodiment could be selected in situations where it may be desirable to spread out the stresses applied by a strap.

Figure 8:
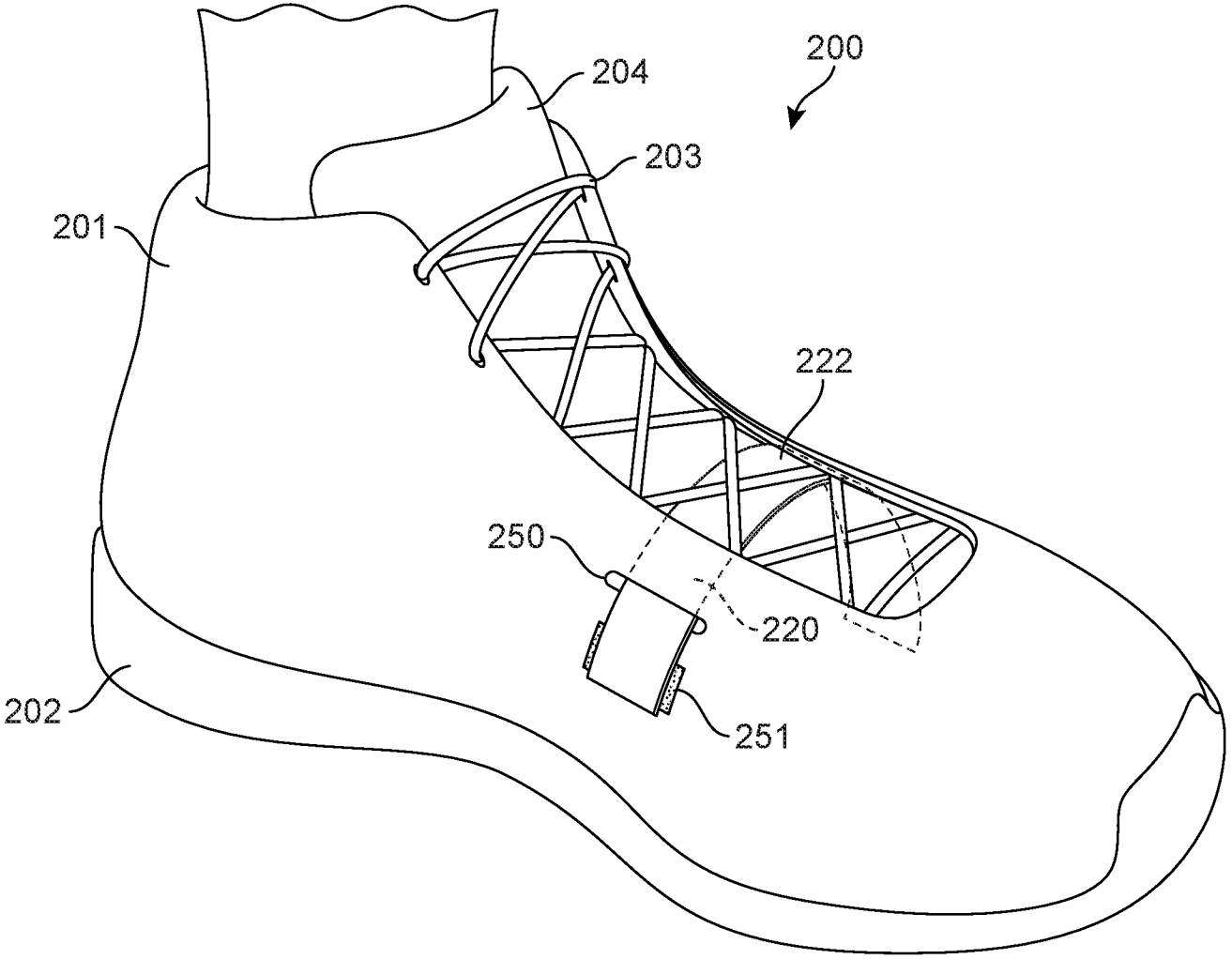
FIG. 8 is an isometric view of yet another embodiment of an article of footwear using a unitary strap.

FIG. 8 is an isometric view of another example of the embodiment of an article of footwear. In this example, the reactive strap 220 is attached at one end to the bottom of the interior of the medial side of upper 201 of footwear 200 or to sole 202. Reactive strap 220 is routed up the side and then between laces 203 and tongue 204 of footwear 200, such that a portion 222 of reactive strap 220 passes over tongue 204. Reactive strap 220 could also be routed beneath the tongue. Reactive strap 220 then emerges from the interior of the lateral side of the footwear through slot 250. Reactive strap 220 is then attached to the exterior of the lateral side of the footwear using, for example, a hook-and-loop fastener 251 such as Velcro®, as shown in FIG. 8, or by some other detachable attachment method such as a buckle, snaps, buttons or laces.

Using the configuration shown in FIG. 8, the effective length of reactive strap 220 may be adjusted. Specifically, the point of attachment between reactive strap 220 and fastener 251 may function as the effective end of reactive strap 220 for purposes of tensioning the foot. Therefore, adjusting the position of reactive strap 220 relative to fastener 251 allows a user to pre-tension reactive strap 220 as desired. The embodiment of FIG. 8 allows for adjustment of the effective length of the reactive strap.

Depending on the particular footwear, a strap (including a reactive strap) may be routed either entirely within the upper, as in the embodiment shown in FIG. 1, or may be routed over the tongue, as shown in FIGS. 7 and 8. The strap may be wrapped over the instep or over the forefoot. It may also be wrapped around the heel or the ankle. In the case of an article of footwear such as a sandal, that does not have an upper, the strap(s) may be attached to the sole. In general, whether attached to the upper or to the sole, one or more straps may be used. For example, one strap may wrap around the heel, a second strap may wrap around the ankle, a third strap may wrap over the instep and a fourth strap may wrap over the forefoot.

Although in many embodiments a strap is generally rectangular, it may have any shape that is suitable for the particular footwear, as long as it can be characterized as having a length, a width and a thickness. For example, the strap may be roughly rectangular, oval, triangular or trapezoidal, or a combination of such shapes. Moreover, the shape of the strap could be regular or irregular.

Figure 9:
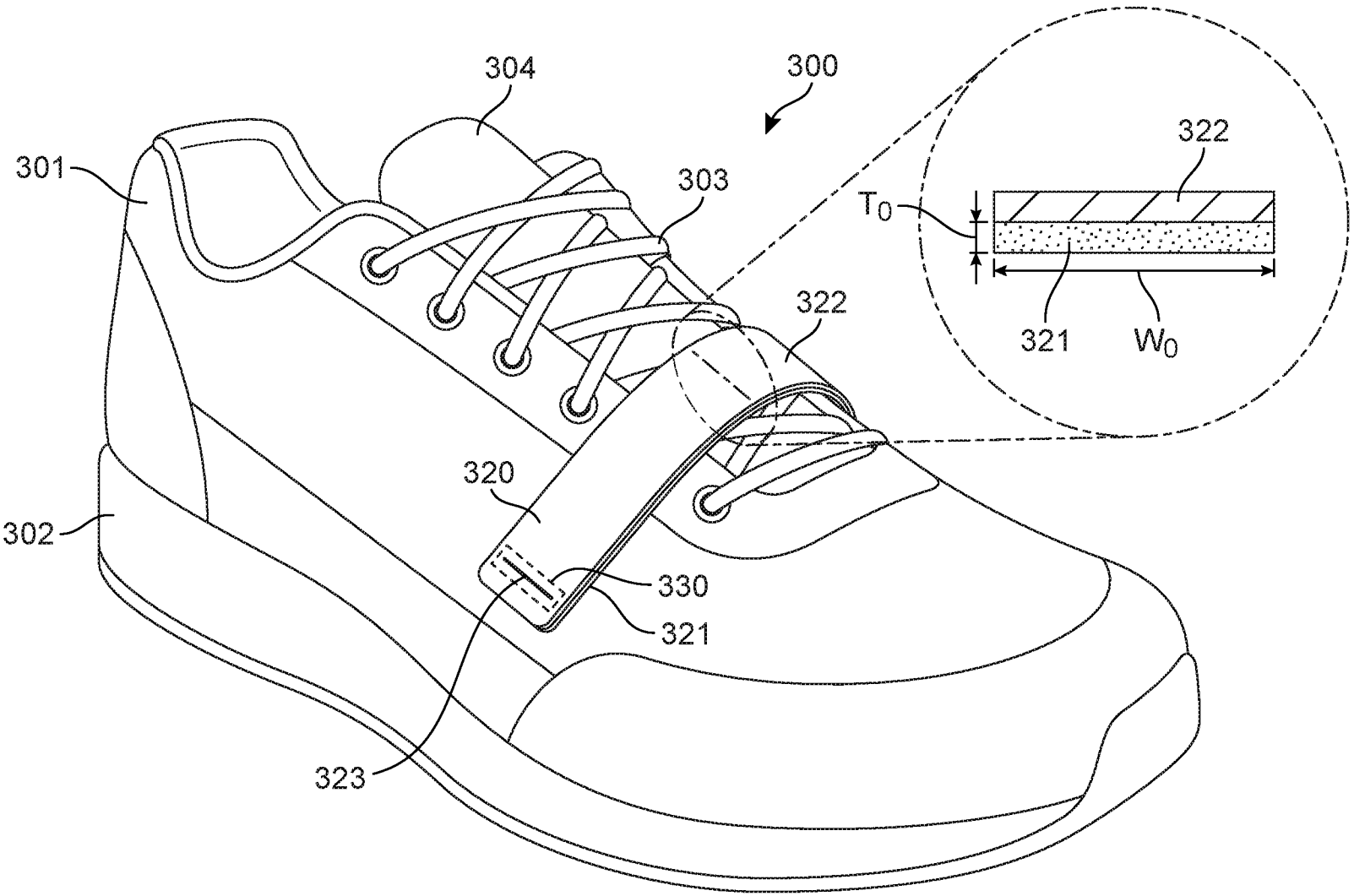
FIG. 9 is an isometric view of an embodiment of an article of footwear using a composite strap.

Embodiments of the article of footwear may use a composite strap instead of a unitary strap. A composite strap may include two or more layers or portions of distinct material. In some cases, a composite strap may include at least two layers, where at least one of the two layers is made of a reactive material. The composite strap could be routed within the upper, as in the examples shown in FIGS. 5-8. As shown in FIG. 9, the composite strap can also be routed over the upper instead of within the upper.

FIG. 9 illustrates another article of footwear 300. Article of footwear 300 may include an upper 301 and sole 302. Further, article of footwear 300 may include laces 303 as well as tongue 304.

Some embodiments of article of footwear 300 may include composite strap 320. Composite strap 320, as shown in FIG. 9, has at least two layers: a reactive layer 321 on the outward side of the composite strap and an inelastic layer 322 on its inward side. Generally, reactive layer 321 and inelastic layer 322 may have different material characteristics. In some embodiments, reactive layer 321 may be fabricated from material with a negative Poisson's ratio so that as reactive layer 321 is placed in tension along a first direction, reactive layer 321 may expand in directions that are generally orthogonal to the first direction. Thus, for example, as reactive layer 321 is placed under tension in a longitudinal direction along composite strap 320, reactive layer 321 may expand in thickness or width or in both thickness and width. Moreover, when tension is applied in a longitudinal direction to inelastic layer 322, inelastic layer 322 substantially resists expansion in the longitudinal direction as well as the lateral and vertical directions. As described in further detail below, this arrangement of reactive layer 321 and inelastic layer 322 allows the expansion of reactive layer 321 in dimensions orthogonal to its length to be controlled in a manner that facilitates increased support for a foot.

Any materials or combination of materials can be used to achieve the above discussed material properties for reactive layer 321 and/or inelastic layer 322. Inelastic layer 322 can be made from materials including, but not limited to: canvas, nylon, Dacron®, denim, EVA or other materials that do not stretch substantially when under tension. Reactive layer 321 may be made from any materials having a negative Poisson's ratio, including, for example, auxetic materials. Such materials are available, for example, from Advanced Fabric Technologies, Houston, Tex. and from Auxetic Technologies Ltd., Bolton, UK. However, it will be understood that a reactive layer may generally be made of any materials that exhibit the material properties described above, including expansion in a direction orthogonal to the direction of applied tension.

In some embodiments, reactive layer 321 may be attached to inelastic layer 322 only at its two longitudinal ends, for example by stitching or stapling, or by using adhesives. In other embodiments, reactive layer 321 and inelastic layer 322 could be joined at any other regions. In still other embodiments, reactive layer 321 may be disposed adjacent to inelastic layer 322, but not directly joined to inelastic layer 322.

Composite strap 320 may be routed within article of footwear 300, or over the footwear, as described below. Depending on the particular footwear and the specific application, the two ends of composite strap 320 may be attached to the medial and lateral sides of upper 301, for example. In other embodiments, for example, they could also be attached to sole 302 or at the interface of upper 301 to sole 302. The attachment method may be fixed, such as stitching, stapling, fusing or using adhesives, or detachable, such as by using buckles, buttons, hook and loop fasteners such as Velcro®, snaps or laces.

In the exemplary embodiment shown in FIG. 9, inelastic layer 322 is attached to footwear 300 on its medial side by stitching (not shown in FIG. 9). It is attached at the lateral side of footwear 300 by stitching 330. As shown in the call-out in FIG. 9 and discussed in more detail below with reference to FIGS. 10-12, when reactive layer 321 is not under tension, it has a thickness $T_0$ and a width $W_0$.

Figure 12:
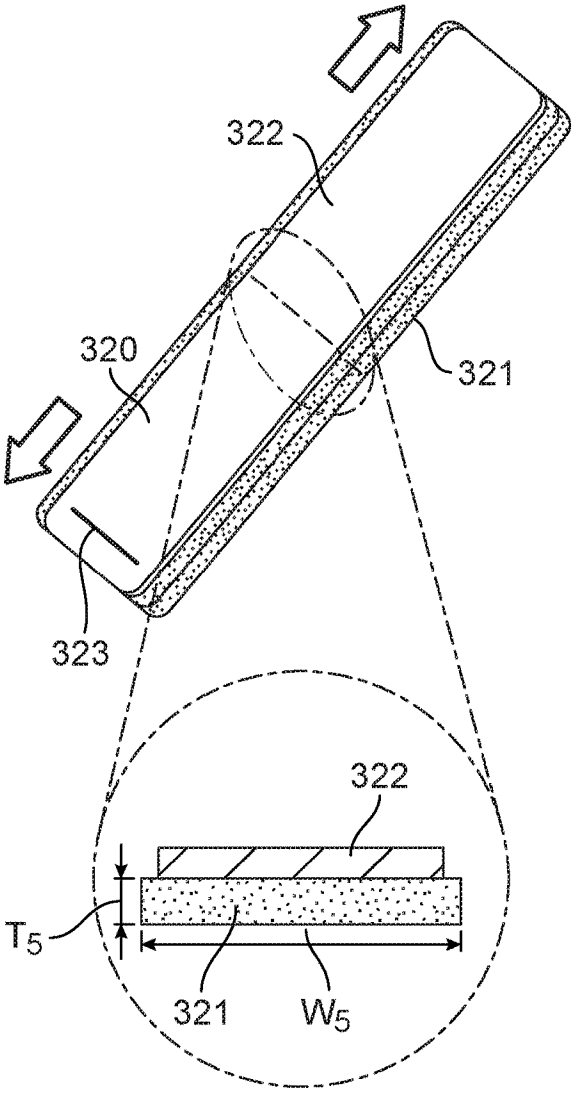
FIG. 12 is an isometric view of an embodiment of a composite strap under increased longitudinal tension.
Figure 11:
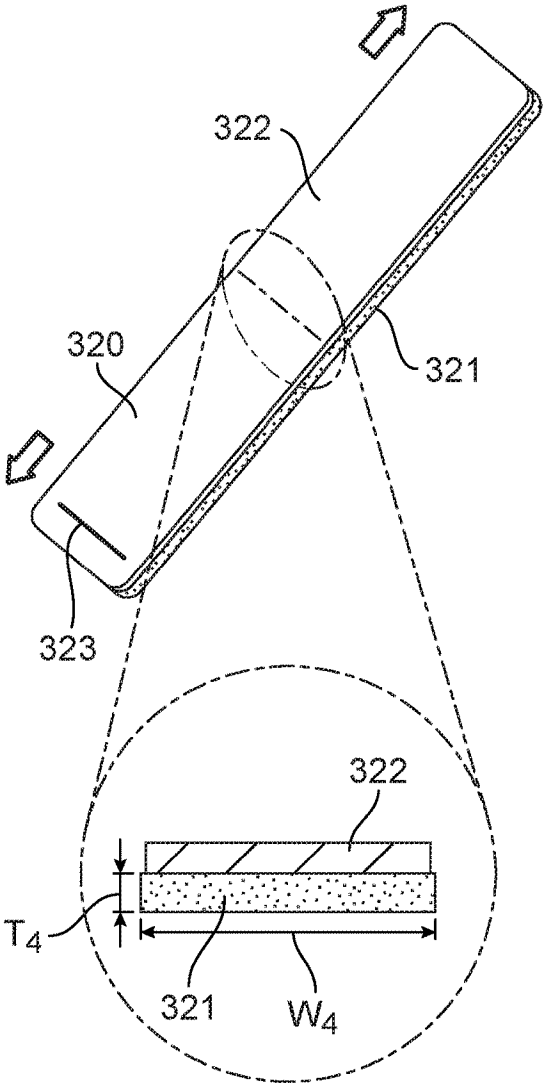
FIG. 11 is an isometric view of an embodiment of a composite strap under longitudinal tension.
Figure 10:
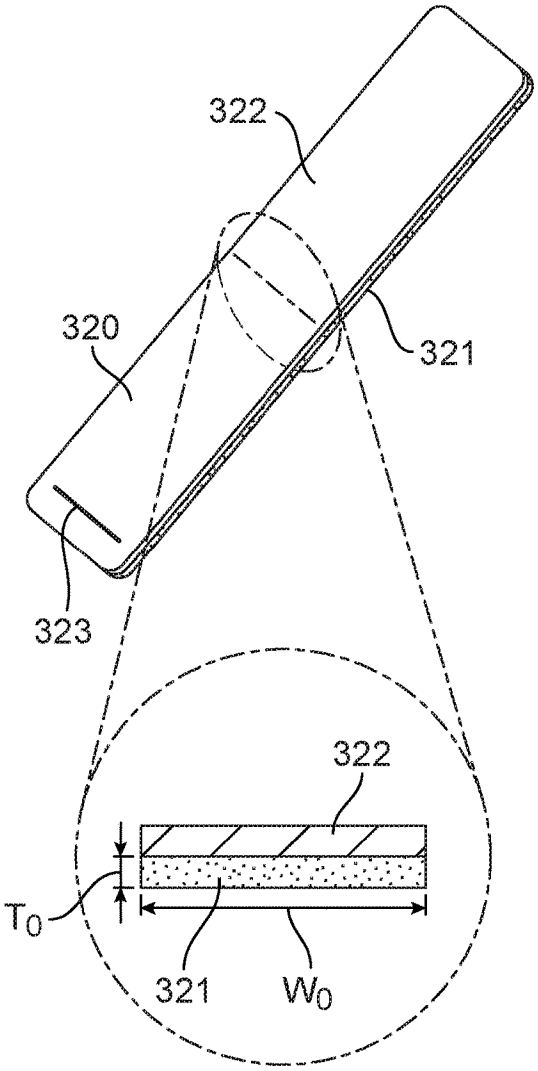
FIG. 10 is an isometric view of an embodiment of a composite strap when it is not subject to any longitudinal tension.

FIGS. 10-12 are isometric views of a composite strap showing how its geometry changes under tension. FIG. 10 is an isometric view of composite strap 320 when it is not under tension. Reactive layer 321 is annotated to designate the width of the reactive layer as $W_0$ and the thickness of the reactive layer as $T_0$. Reactive layer 321 is attached to inelastic layer 322 at both ends by stitching 323. In the current embodiment, reactive layer 321 is not attached in any other way to inelastic layer 322. However, it is possible that in other embodiments, reactive layer 321 and inelastic layer 322 could be attached at other locations. In still other embodiments, reactive layer 321 and inelastic layer may not be attached to each other at any location.

FIG. 11 is an isometric view of an example of composite strap 320 when it is under longitudinal tension, as indicated by the arrows at both ends of the strap. As shown in FIG. 11, the thickness $T_4$ and width $W_4$ of reactive layer 321 have increased compared to the thickness $T_0$ and width $W_0$ when the reactive layer is not under tension (as shown in FIG. 10). In other words, $T_4$ is greater than $T_0$ and $W_4$ is greater than $W_0$.

FIG. 12 is an isometric view of an example of composite strap 320 when it is under increased longitudinal tension compared to the example shown in FIG. 11. In this case, the thickness $T_5$ and width $W_5$ of reactive layer 321 have increased compared to the thickness $T_1$ and width $W_1$ when the reactive layer is under less tension (as shown in FIG. 11). In other words, $T_5$ is greater than $T_4$ and $W_5$ is greater than $W_4$.

To be clear, in the composite strap embodiments shown in FIGS. 10-12, the inelastic layer does not experience any significant changes in any of its dimensions. The length may increase a minimal amount, and the inelastic layer may have even smaller and less significant changes in its width and its thickness. In other embodiments, however, a composite strap could include a layer different from a reactive layer that does change significantly in one or more dimensions. For example, some embodiments could include an elastic layer that increases in length and contracts in width and/or thickness under longitudinal tension.

Figure 13:
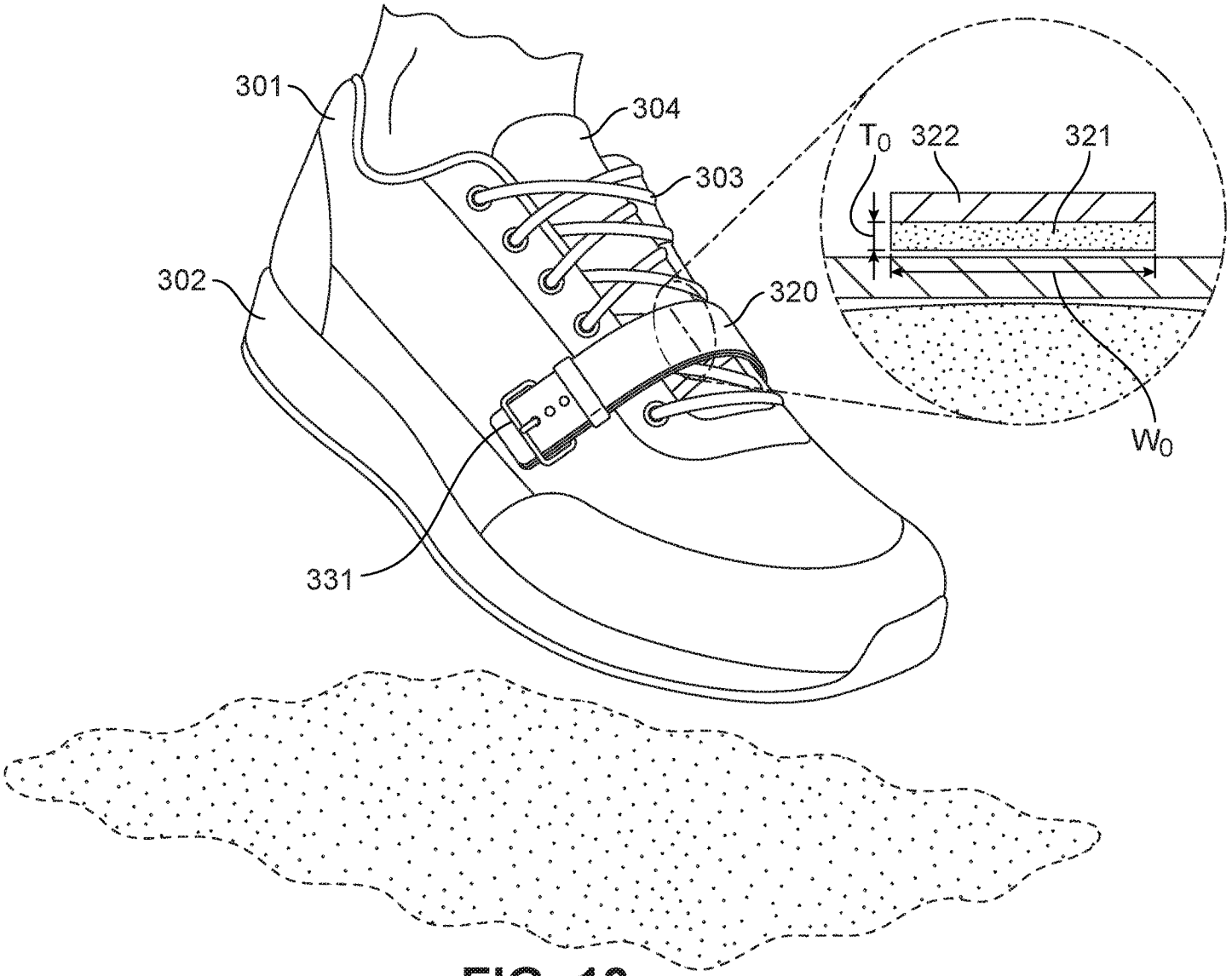
FIG. 13 is an isometric view of the footwear of FIG. 9 above a playing surface.

FIG. 13 is an isometric view of an article of footwear in action. In this example, because the foot has not yet reached the ground, composite strap 320 is not experiencing substantial longitudinal tension. Because composite strap 320 is not experiencing substantial longitudinal tension, reactive layer 321 has a thickness and width that is not substantially greater than the thickness $T_0$ and width $W_0$ when reactive layer 321 is not under tension.

In the example shown in FIG. 13, composite strap 320 is attached to the lateral side of article of footwear 300 by buckle 331. Composite strap 320 could also be attached using any other detachable device such as a hook and loop fastener (such as Velcro®), laces, snaps or other detachable mechanical device, or by a permanent attachment such as stitches, staples, fusion or adhesives. Composite strap 320 can be attached to the medial side of article of footwear 300 by, for example, using a permanent attachment method such as stitching, stapling, fusion or adhesives.

Figure 14:
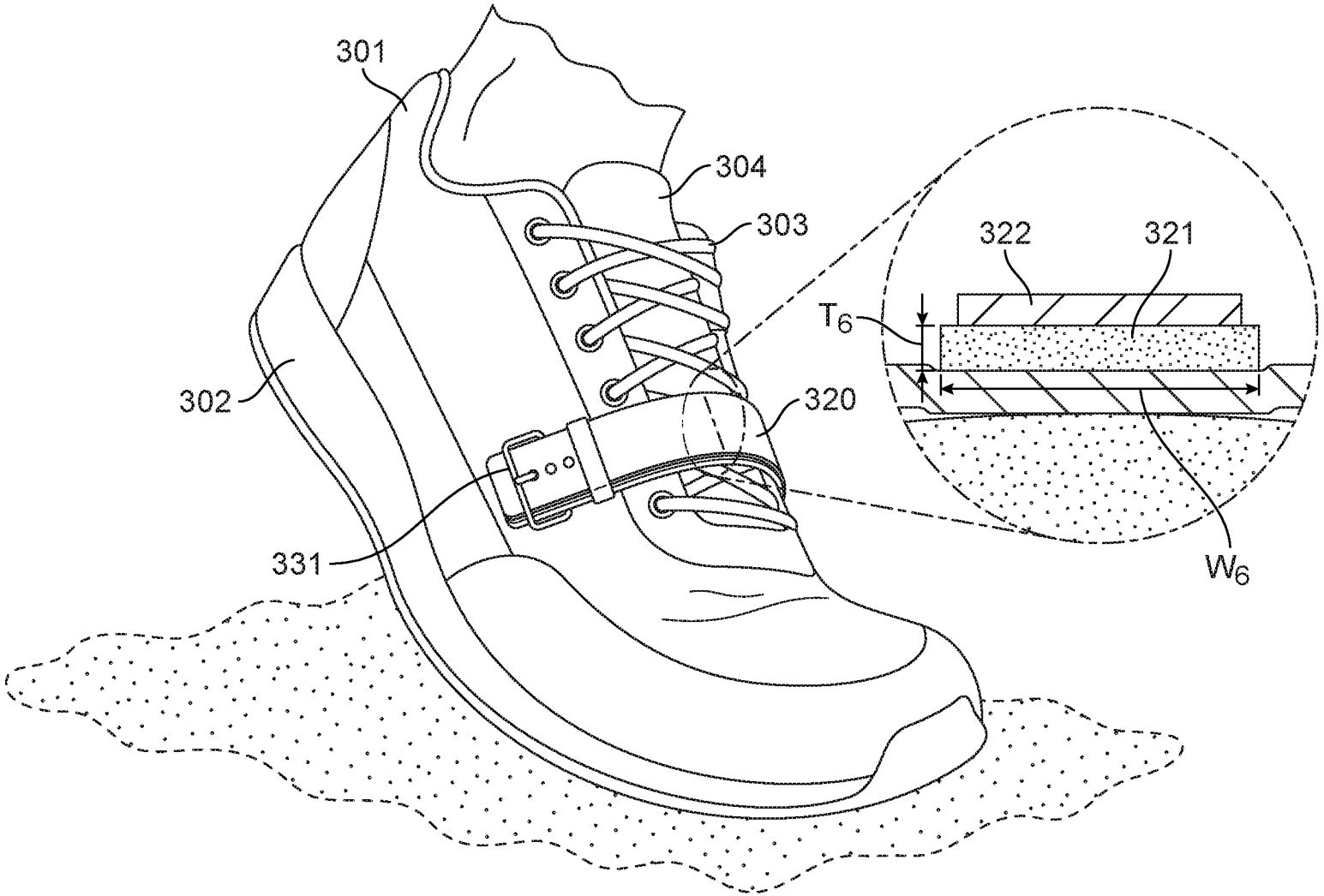
FIG. 14 is an isometric view of the footwear of FIG. 9 in contact with a playing surface.

FIG. 14 is an isometric view of the article of footwear shown in FIG. 13, when the footwear is pressed hard against the playing surface, for example because the wearer is leaping or accelerating forward. In this case, composite strap 320 is under greater tension than in the example shown in FIG. 13. Because reactive layer 321 is under tension, its thickness and width increase to $T_6$ and $W_6$, respectively. Because 321 reactive layer is constrained by inelastic layer 322, it presses more firmly down (or radially inwardly) towards the top of the footwear. At the same time, the increased width of reactive layer 321 results in a wider contact area between composite strap 320 and the top of article of footwear 300. Both of these actions—the increased thickness and the increased width—serve to hold article of footwear 300 more securely to the wearer's foot and thus provide more stability to the wearer.

The composite strap may be attached to any part of the footwear using any kind of attachment mechanism, including both permanent attachment mechanisms such as stitching, stapling, using adhesives or fusing, or a detachable mechanism such as a buckle, a hook and loop fastener, a snap or laces. In some embodiments, a permanent attachment method could be used on the medial side and either a permanent or detachable method could be used on the lateral side. However, other embodiments could include fasteners on the lateral side.

The footwear shown generically in FIGS. 9 and 13-14 is representative of many kinds of footwear, including for example, running shoes, walking shoes, hiking boots, work boots, tennis shoes, jogging shoes, basketball shoes, soccer shoes, baseball shoes, skates, ski boots and other types of footwear.

Straps (including unitary and composite straps) with reactive materials could be disposed on any portion of an article of footwear. In some embodiments, a strap can be positioned at the instep, as shown in FIGS. 1, 5-9 and 13-14. In other embodiments, a strap could wrap around the ankle and/or the heel. In still other embodiments, a strap could be positioned at the forefoot of the footwear.

In different embodiments, straps could have any kinds of shapes. Although the strap is shown in the figures as having a generally rectangular shape, in other embodiments a strap could have an oval shape or any other shape that allows the material to be held under tension in one direction. Examples of other possible shapes for a strap include, but are not limited to: round, triangular rectangular, polygonal, regular and irregular shapes.

In some embodiments, reactive material may be integrated within an upper. In particular, in some embodiments, a reactive material can comprise one or more portions or sections of the upper. These portions of a reactive material may be disposed adjacent portions of more conventional upper materials.

Figure 15:
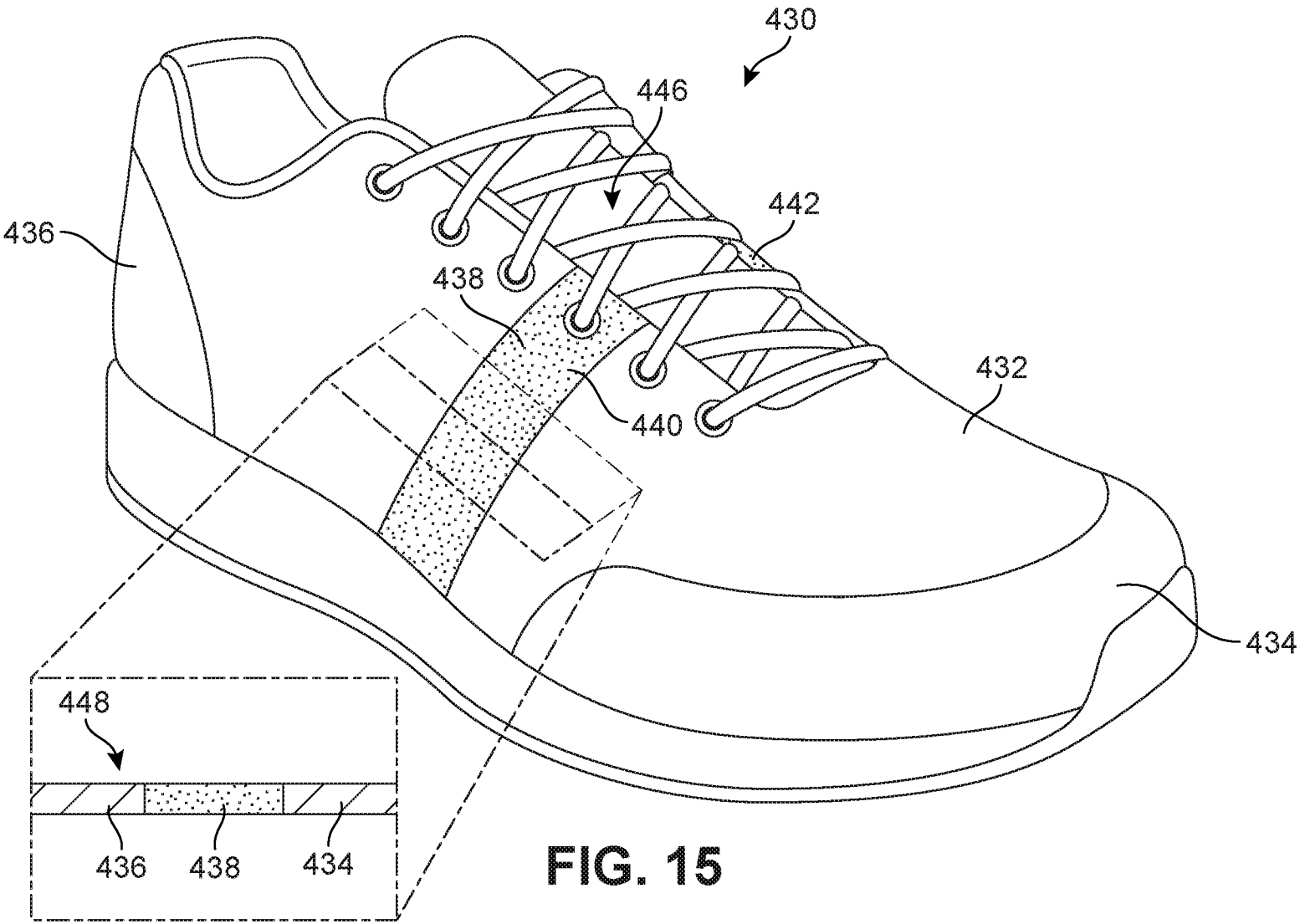
FIG. 15 is an isometric lateral view of an embodiment of an article of footwear including an integrated reactive strap.
Figure 16:
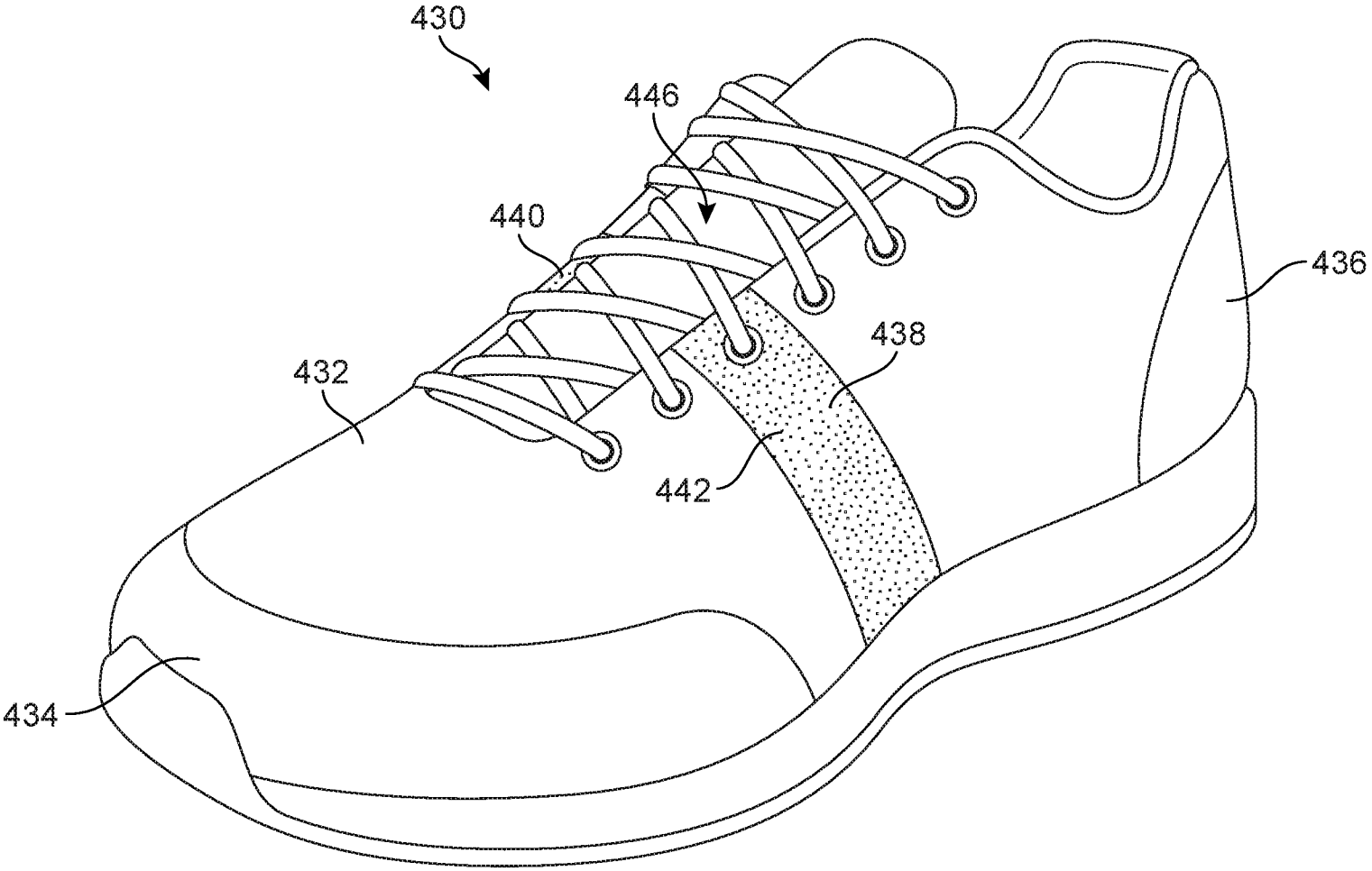
FIG. 16 is an isometric medial view of an embodiment of an article of footwear including an integrated reactive strap.

FIGS. 15 through 21 illustrate still further configurations for integrating a reactive material into an upper. Referring first to FIGS. 15 and 16, in some embodiments a reactive material may comprise a section of an upper material. As an example, article of footwear 430 may include upper 432. Upper 432 may include a forward portion 434, a rearward portion 436 and an intermediate portion 438 that is disposed between the forward portion 434 and the rearward portion 436. Intermediate portion 438 may be further separated into a lateral intermediate portion 440 and a medial intermediate portion 442, which may be separated by throat opening 446. In some cases, forward portion 434 and rearward portion 436 may comprise conventional upper materials such as synthetic leather, mesh materials as well as possibly other materials. In particular, forward portion 434 and rearward portion 436 may comprise materials with a positive Poisson's ratio. In contrast, in some cases, intermediate portion 438 (including both lateral intermediate portion 440 and medial intermediate portion 442) may be made of a reactive material with a negative Poisson's ratio. Thus, intermediate portion 438 may comprise a portion that that expands in thickness under longitudinal tension. Moreover, the relatively narrow width of intermediate portion 438, compared with forward portion 434 and rearward portion 436, may allow intermediate portion 438 to operate in a similar manner to a strap, thereby constraining the radial portion of a foot within upper 432 in a similar manner to straps of the previous embodiments.

Figure 18:
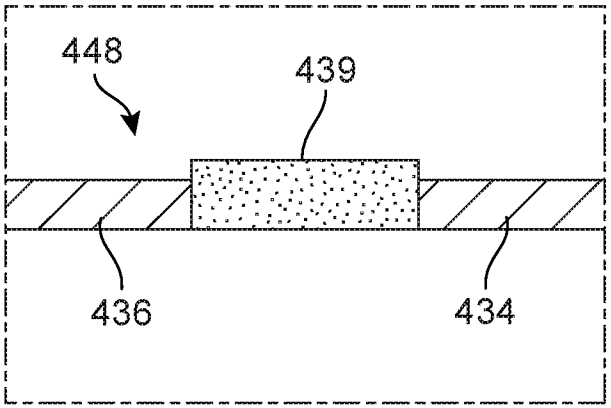
FIG. 18 is an enlarged cross-sectional view of a portion of an upper including a reactive strap.
Figure 17:
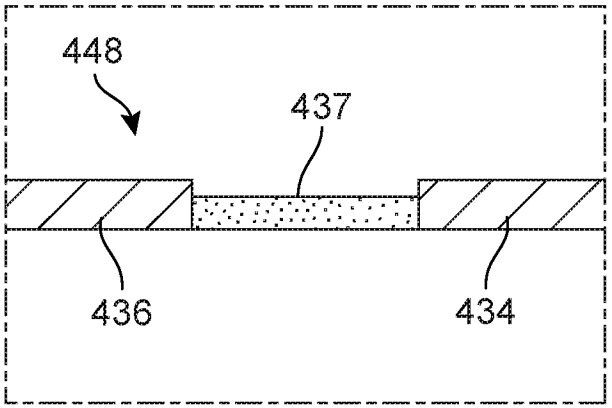
FIG. 17 is an enlarged cross-sectional view of a portion of an upper including a reactive strap.

FIGS. 15 and 16 illustrate an embodiment of intermediate portion 438 comprising a reactive material that is generally flush with an outer surface 448 of upper 432 defined by forward portion 434 and rearward portion 438. However, in other embodiments, intermediate portion 438 could be recessed below, or extended above, outer surface 448 of upper 432. For example, FIG. 17 illustrates a cross sectional view of a portion of upper 432 in which an intermediate portion 437 is recessed below outer surface 448. Likewise, FIG. 18 illustrates a cross sectional view of a portion of upper 432 in which an intermediate portion 439 is raised above outer surface 448. Moreover, although the current embodiment discusses the relative position of an intermediate portion with respect to an outer surface of an upper, in other embodiments an intermediate portion could be flush, recessed or lowered similar with respect to an inner surface of an upper.

Figure 19:
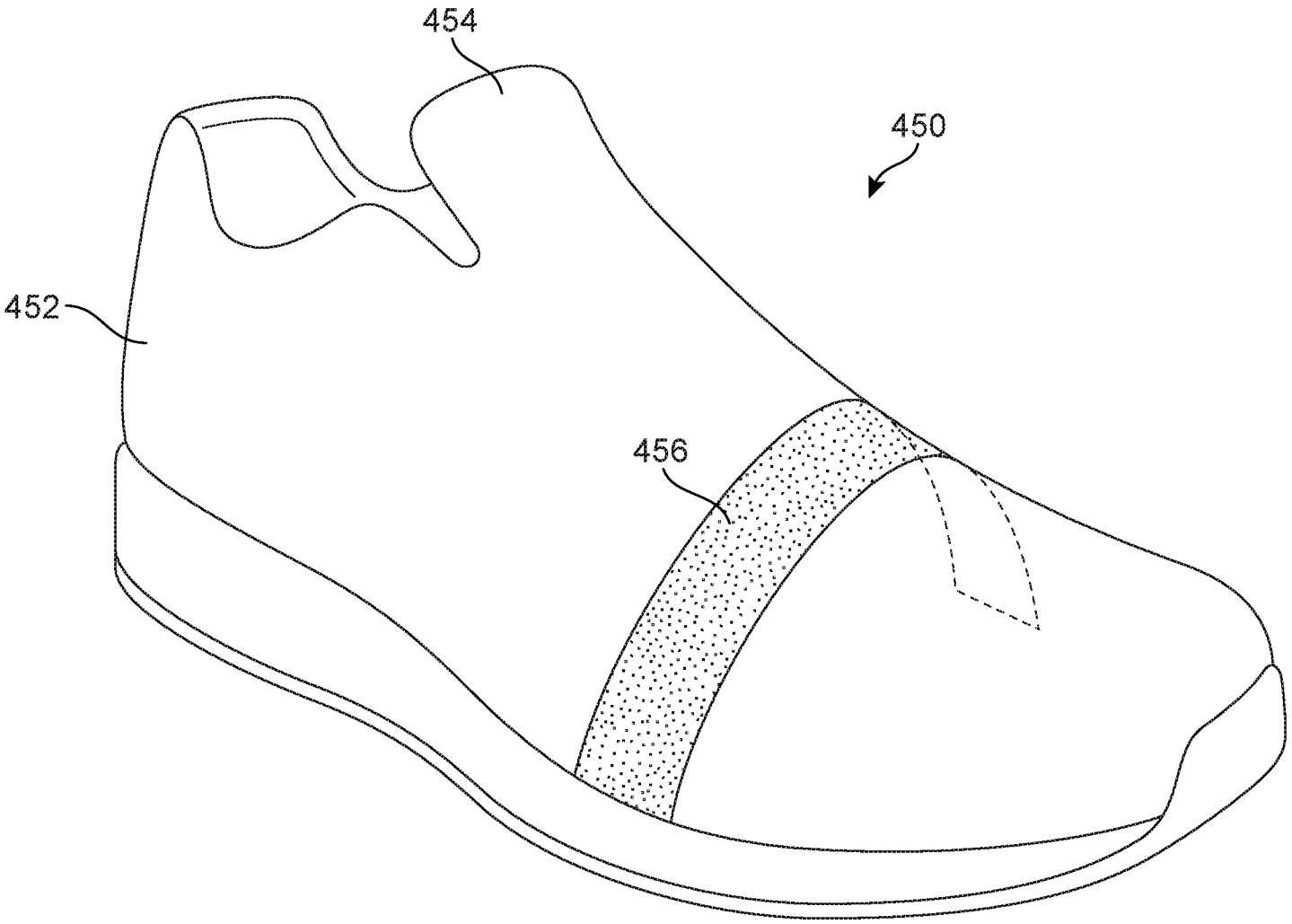
FIG. 19 is an isometric view of an embodiment of an article with an integral tongue including a reactive strap.

FIG. 19 illustrates a schematic view of an embodiment of an article of footwear 450 including an upper 452 with integral tongue 454. In some embodiments, upper 452 may further include reactive strap 456 that is integral with upper 452. Reactive strap 456 may extend continuously from a lateral side to a medial side of upper 452. In some embodiments, upper 452 may operate without a traditional lacing system, thereby providing a loose fit until tension is applied, at which point reactive strap 456 may tighten around a foot.

Figure 20:
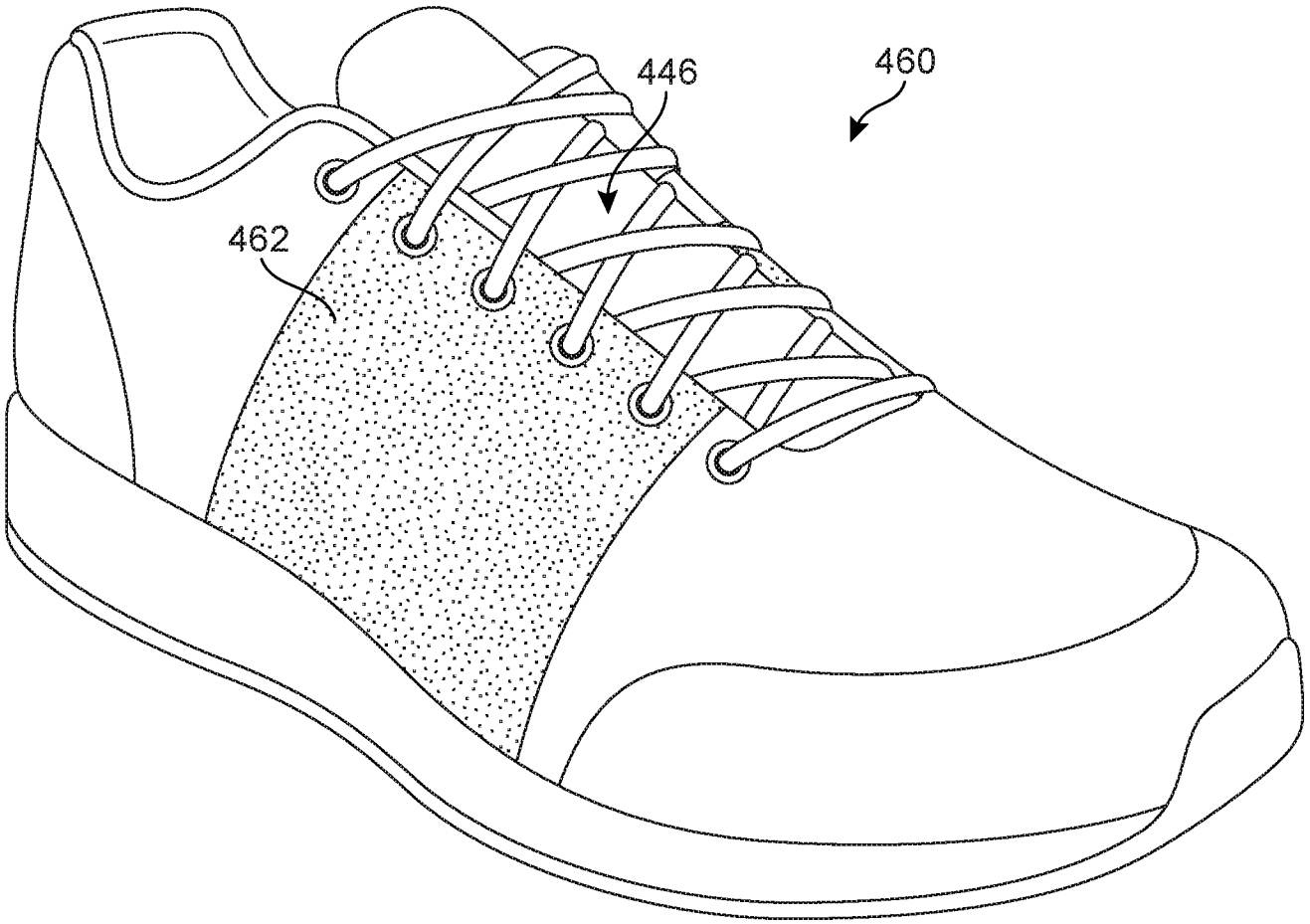
FIG. 20 is an isometric view of an embodiment of an article of footwear with a reactive material integrated into a throat portion of an upper.
Figure 21:
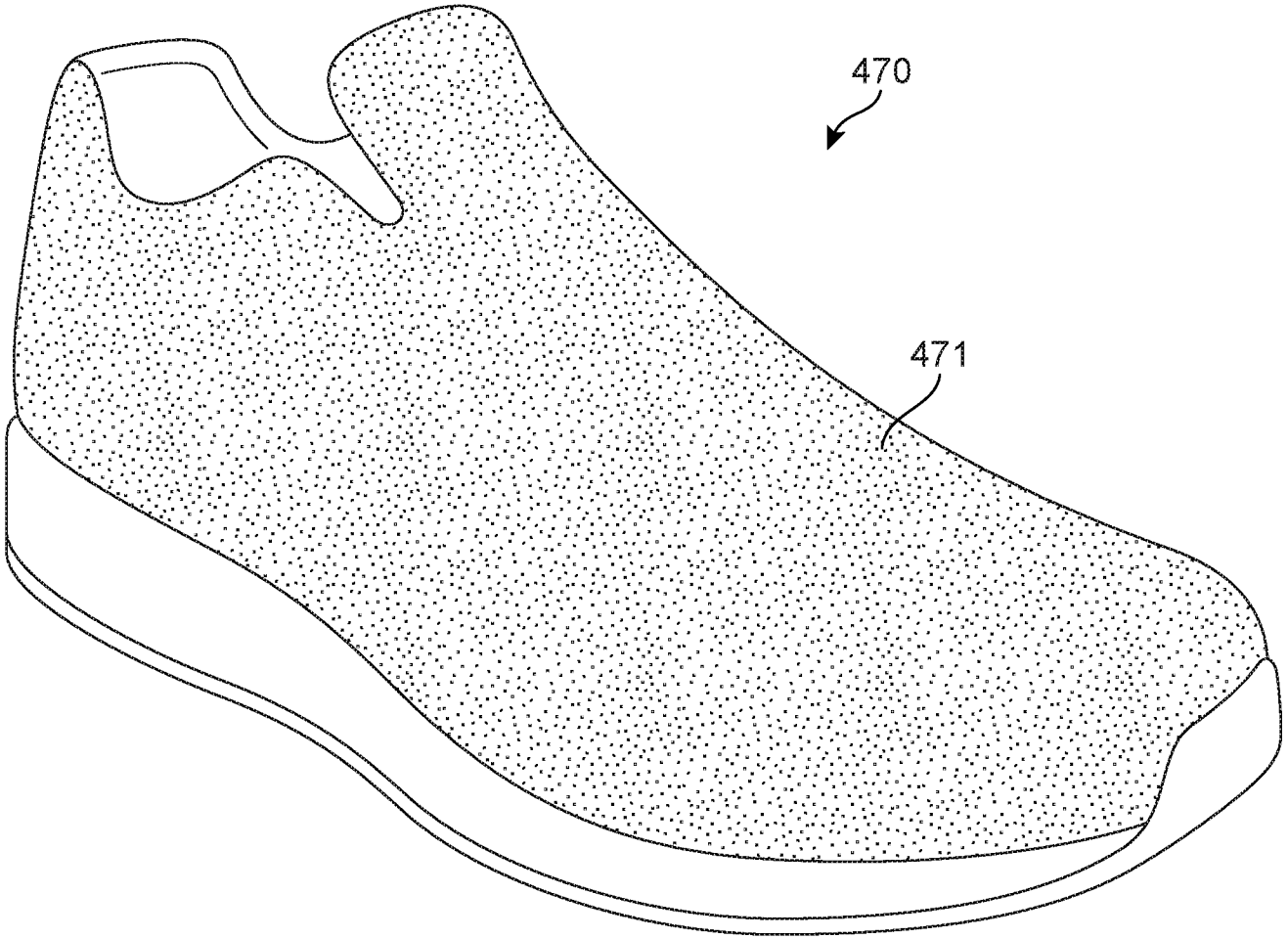
FIG. 21 is an isometric view of an embodiment of an article of footwear including an upper comprising a reactive material.

Referring to FIGS. 20 and 21, a reactive material could be integrated into various regions of an article. For example, referring to FIG. 20, article 460 may include a reactive portion 462 that extends along a large portion throat region 464. In particular, reactive portion 462 is seen to have a substantially greater width than intermediate portion 438 shown in FIGS. 15 and 16. In still other embodiments, a reactive material 471 may comprise the majority of an upper 470, as shown in FIG. 21. In the embodiment of FIG. 21, the substantial entirety of upper 470 may increase in thickness when tensioned along any direction approximately parallel to the surface of upper 470.

Thus, it will be understood that embodiments can include uppers having various different portions comprising a reactive material. The size, shape and location of these portions (also referred to as straps) can vary according to factors including, but not limited to: type of footwear, desired support during inactivity, desired support during various kinds of activity, desired locations for support as well as other factors.

Figure 22:
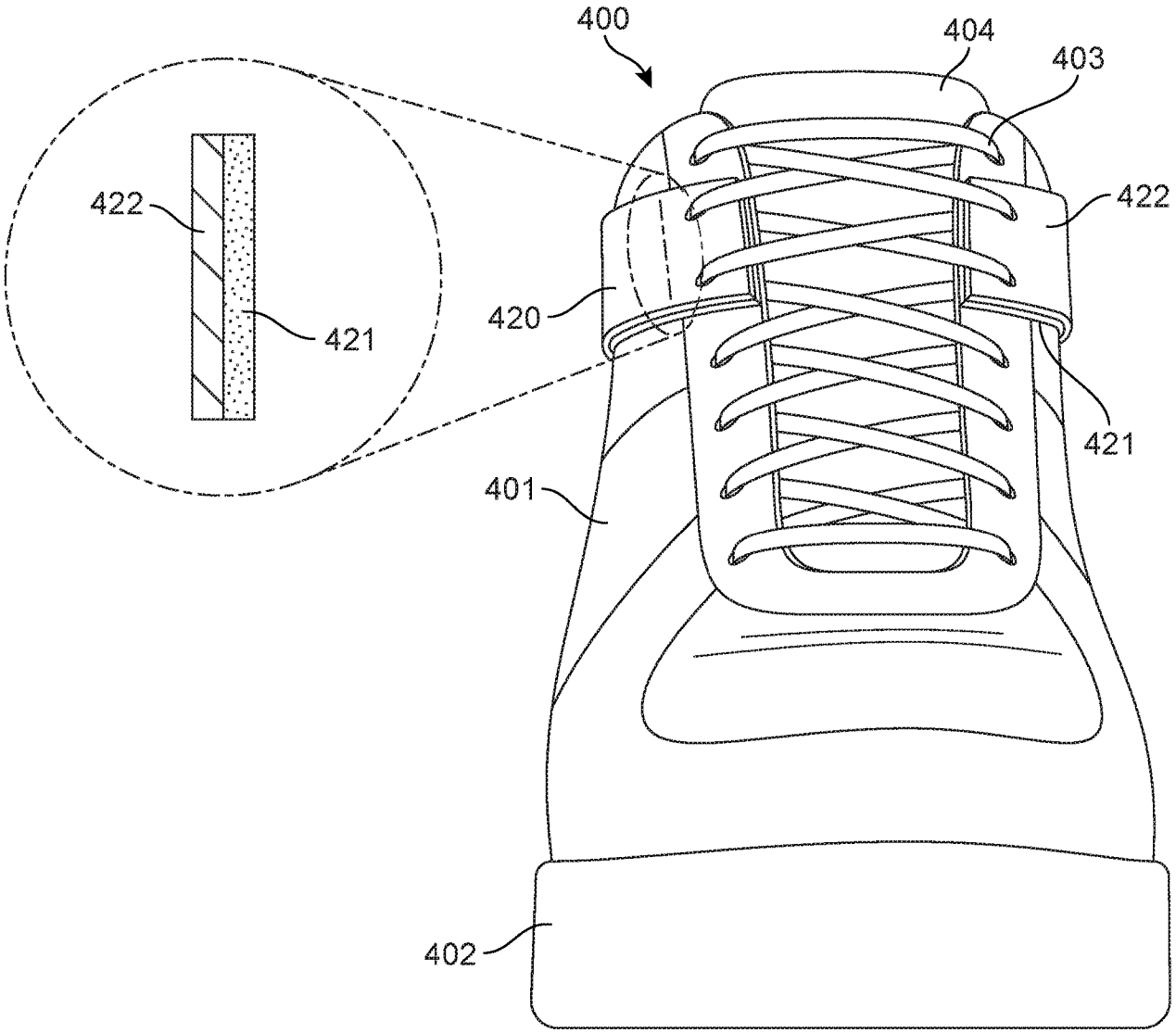
FIG. 22 is an isometric view of an embodiment of an article of footwear with a composite strap for providing increased support at a wearer's ankle.

FIG. 22 is an isometric view of an article of footwear, in this case a hi-top shoe, with a composite strap routed around the ankle. Composite strap 420 has an inner reactive layer 421 and an outer inelastic layer 422, i.e., composite strap 420 is similar to the composite strap shown in FIGS. 10-12. Composite strap 420 is held in place on one side of the footwear by lace 403. It is then routed over upper 401 around the wearer's ankle to the other side of the footwear, where it is held by lace 403. When the wearer flexes or turns his or her ankle, thus creating additional tension on composite strap 420, the inner reactive layer expands in thickness and/or in width, thus providing additional support for the wearer's ankle.

Figure 23:
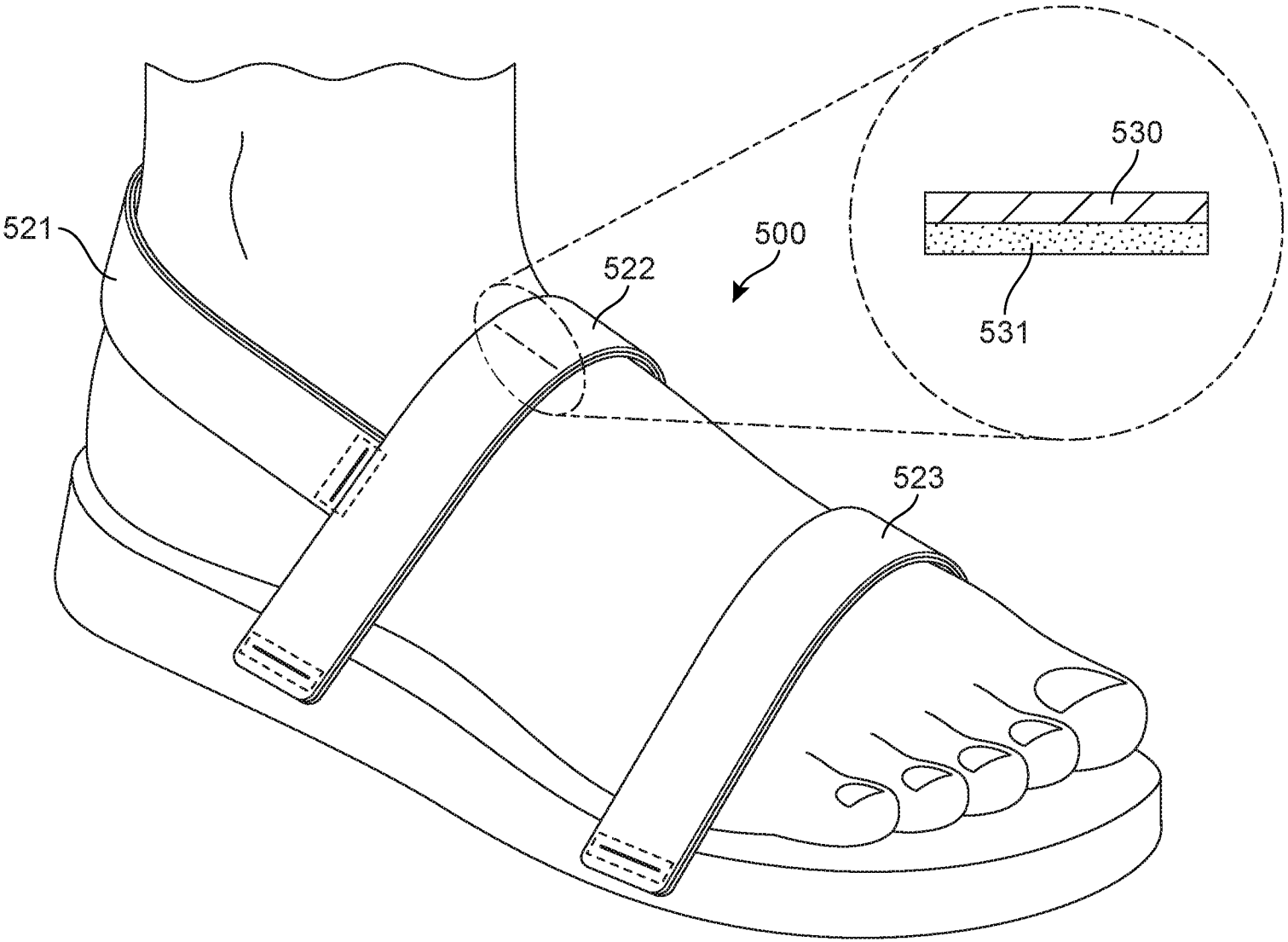
FIG. 23 is an isometric view of an embodiment of a sandal with composite straps.
Figure 24:
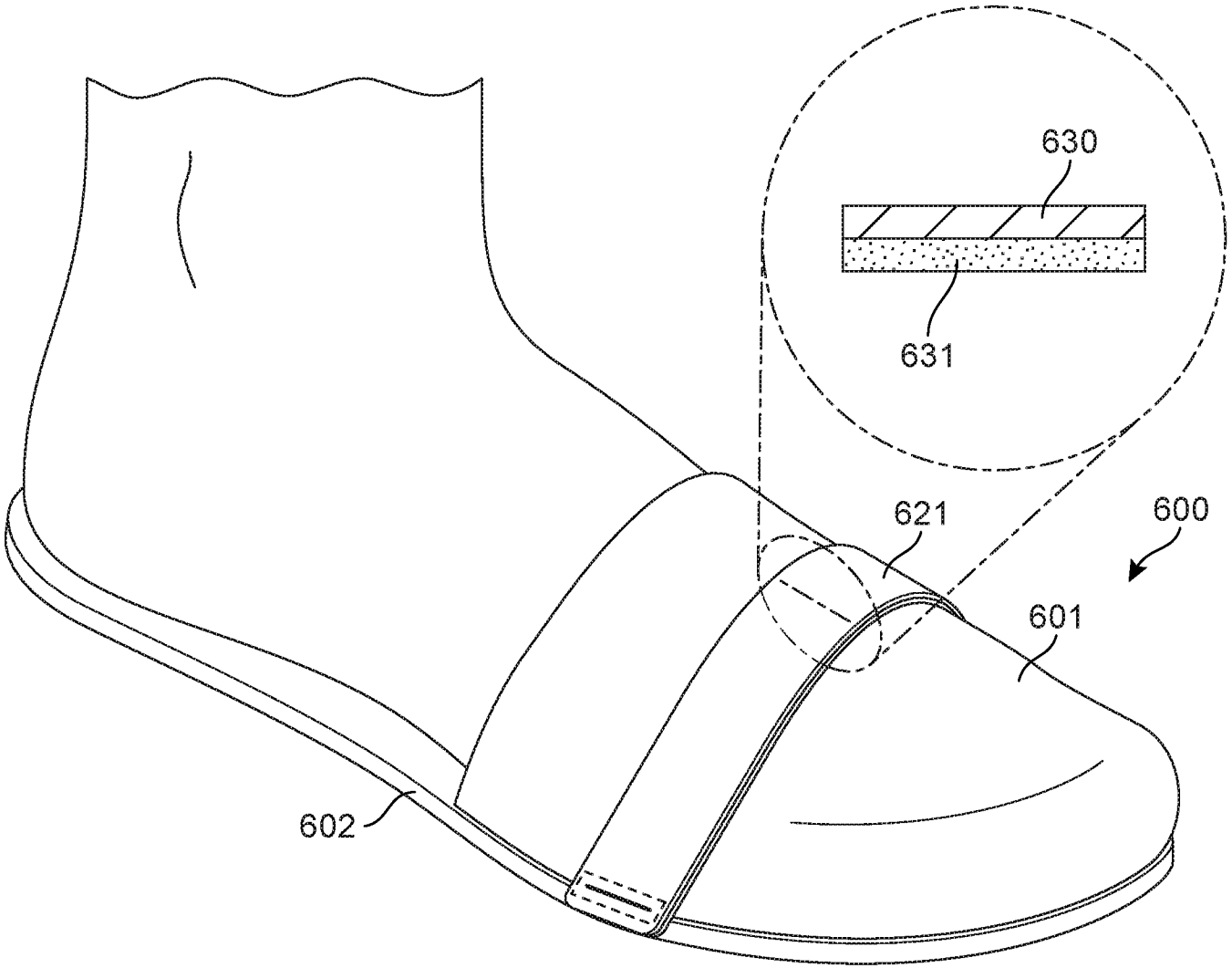
FIG. 24 is an isometric view of an embodiment of a slipper with a composite strap.
Figure 25:
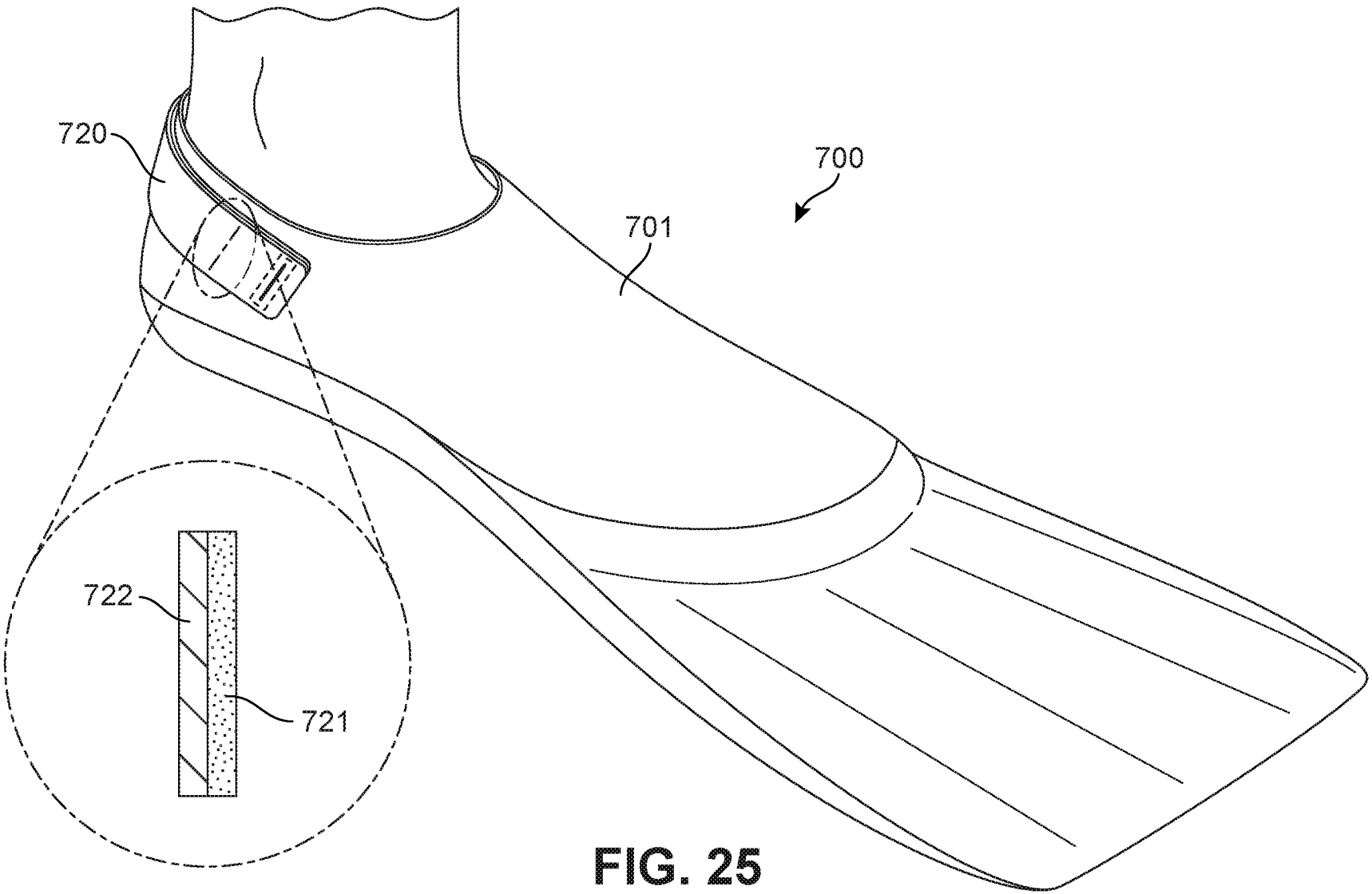
FIG. 25 is an isometric view of an embodiment of a flipper with a composite strap.

FIGS. 23, 24 and 25 show examples of the use of a composite strap, on a sandal, a slipper and a flipper, respectively. In each example, the composite strap has an inner reactive layer and an outer inelastic layer. The outer inelastic layer serves to constrain the inner reactive layer when that layer is under tension, such that the reactive layer is forced to exert additional pressure on the wearer's foot and thus more securely hold the footwear onto the foot.

FIG. 23 is an isometric view of a sandal with composite straps wrapped around the heel, at the instep and at the forefoot. In different embodiments, sandals could have any one or two of these composite straps, or all three composite straps. Still other embodiments could include four or more composite straps. Furthermore, some embodiments could incorporate a combination of unitary straps and composite straps.

Composite strap 521, composite strap 522 and composite strap 523 are generally similar to the composite strap shown in FIGS. 10-12. Each composite strap may include an outer inelastic layer 530 and an inner reactive layer 531, as indicated specifically for composite strap 521 in FIG. 23. In this example, composite strap 521 is attached on either side of the foot to composite strap 522. However in other examples it could be attached on either side of the sole. Composite strap 522 and composite strap 523 can be attached to the sole using a permanent attachment method such as stitching, stapling, fusion or adhesives, or by a detachable method such as buckles, hook and loop fasteners, hooks, buttons or laces.

FIG. 24 is an isometric view of a slipper 600 with a composite strap at the forefoot. Composite strap 621 is generally similar to the composite strap shown in FIGS. 10-12 (including an outer inelastic layer 630 and an inner reactive layer 631). Composite strap 621 may be attached to one side of sole 602 using a permanent attachment method such as stitching, stapling, fusion or adhesives, or by a detachable method such as buckles, hook and loop fasteners, hooks, buttons or laces. In some embodiments, composite strap 621 may be attached at the other side of sole 602 by a permanent attachment method. It could alternatively be attached to the sides of upper 601.

In the embodiment of FIG. 24, the wearer's foot would fit comfortably in slipper 600 when strap 621 is not under tension, but would tighten up when the wearer is walking so as to prevent the slipper from slipping off the foot.

FIG. 25 is an isometric view of a flipper 700, with a composite strap around the heel. Composite strap 720 is generally similar to the composite strap shown in FIGS. 10-12., i.e., it has an inner reactive layer 721 and an outer inelastic layer 722. It can be attached to one side of the heel using a permanent attachment method such as stitching, stapling, fusion or adhesives, or by a detachable method such as buckles, hook and loop fasteners, hooks, buttons or laces. In some embodiments, composite strap 720 may be attached at the other side of the heel by a permanent attachment method.

In the embodiment of FIG. 25, flipper 700 would normally be held fairly tightly on the wearer's foot by strap 721 when strap 721 is not under tension. However, when the wearer is kicking his or her feet when swimming, the increased tension on strap 721 provides increased tightening to secure flipper 700 even more firmly to the foot.

In addition to the articles of footwear described above, unitary reactive straps or composite straps including a reactive layer may be used in many other types of footwear, such as boots, skates, ski boots, ballet shoes, football shoes, bicycle shoes, soccer shoes and volleyball shoes. These articles of footwear may include one or several unitary or composite straps, at any one or more different locations, such as at the instep, the heel, the ankle and the forefoot.

The descriptions above have described reactive materials that increase in both thickness and width when under longitudinal tension. However, the disclosure herein can be used with reactive materials that only increase in thickness, or only increase in width. Either of these dimensional changes would improve the ability of the strap to securely hold the footwear on the foot.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear comprising:

an upper defining an opening for receiving a foot of a wearer, the upper having a throat opening provided between a medial side of the upper and a lateral side of the upper;

the upper further including a forward portion for receiving a forefoot of the foot, a rearward portion for receiving a heel of the foot, and an intermediate portion between the forward portion and the rearward portion;

a sole structure affixed to an under side of the upper and extending from the medial side to the lateral side, and from the forward portion to the rearward portion; and wherein the intermediate portion comprises a reactive material extending between the sole structure and the throat opening on both the medial side and on the lateral side of the upper, the reactive material bounded on a forward side by a first material, and on a rearward side by a second material; and wherein the reactive material has a negative Poisson's ratio, and each of the first material and the second material have a positive Poisson's ratio; and wherein the reactive material is operative to expand in thickness to apply a compressive force against the foot of the wearer when the reactive material is tensioned in a direction extending between the throat opening and the sole structure.

2. The article of claim 1, wherein the first material and the second material are the same.

3. The article of claim 1, wherein each of the first material and the second material comprise a synthetic leather or a mesh material.

4. The article of claim 1, wherein the forward portion comprises the first material, and the rearward portion comprises the second material.

5. The article of claim 4, wherein the forward portion is directly coupled to the reactive material on the forward side, and wherein the rearward portion is directly coupled to the reactive material on the rearward side.

6. The article of claim 1, wherein the reactive material is integral with the upper.

7. The article of claim 1, wherein an outer surface of the reactive material is flush with an outer surface of both the forward portion and the rearward portion.

8. The article of claim 1, wherein the outer surface of the reactive material is not flush with an outer surface of at least one of the forward portion or the rearward portion.

9. The article of claim 1, wherein the upper further comprises a plurality of eyelets extending through a thickness of the upper and each adapted to receive a lace; and wherein at least one of the plurality of eyelets extends through the reactive material.

10. The article of claim 9, wherein each of the plurality of eyelets extends through the reactive material.

* * * * *